US005107408A

United States Patent [19]

Vernondier

[11] Patent Number: 5,107,408

[45] Date of Patent: Apr. 21, 1992

[54] LIGHTING SYSTEM

[75] Inventor: David R. Vernondier, Middlesex, England

[73] Assignee: Consumerville Limited, Staines, England

[21] Appl. No.: 654,193

[22] Filed: Feb. 12, 1991

Related U.S. Application Data

[63] Continuation-in-part of Ser. No. 328,455, Mar. 24, 1989, Pat. No. 4,994,944.

[30] Foreign Application Priority Data

Mar. 31, 1988 [GB] United Kingdom ..... 8807758

[51] Int. Cl.[5] ..... F21V 1/00

[52] U.S. Cl. ..... 362/238; 362/219; 362/223; 362/240; 362/249; 362/800; 439/210

[58] Field of Search ..... 362/240, 238, 223, 225, 362/800, 362, 249, 219, 221, 222, 145, 146, 152, 153; 439/232, 210, 541, 419, 239, 346

[56] References Cited

U.S. PATENT DOCUMENTS

| | | | |
|---|---|---|---|
| 3,755,663 | 9/1973 | George, Jr. | 362/249 |
| 4,042,290 | 9/1977 | Czitrom | 439/232 |
| 4,096,379 | 6/1978 | Taylor | 362/235 |
| 4,413,311 | 11/1983 | Orenstein | 362/362 |
| 4,607,317 | 8/1986 | Lin | 362/362 |
| 4,654,765 | 3/1987 | Laidman | 362/238 |
| 4,855,882 | 8/1989 | Boss | 362/238 |

FOREIGN PATENT DOCUMENTS

| | | | |
|---|---|---|---|
| 2308051 | 11/1976 | France . | |
| 48639 | 12/1972 | Japan | 236/238 |

*Primary Examiner*—James C. Yeung
*Attorney, Agent, or Firm*—Dennison, Meserole, Pollack & Scheiner

[57] ABSTRACT

A lighting system includes a plurality of modular components, comprising elongate strips of different finite lengths having elongate lighting circuits therein and connector means for connecting adjacent strips end to end and electrically connecting the lighting circuits thereon to enable a voltage to be applied across a series of illuminating devices provided at predetermined spaced locations along the length of the strips so connected. The illuminating devices on each strip are connected in series and the series connected illuminating devices associated with each strip are connected in parallel with the series connected illuminating devices associated with each of the other strips. The series connection of the illuminating devices associated with the respective strips are balanced so that they are voltage compatible with one another. In some embodiments a plurality of series connected illuminating devices are provided on each strip. Ring voltage supply lines and voltage pulse control lines may also be provided on the strips.

20 Claims, 26 Drawing Sheets

SW1
SW2
SW3
201
200
202
203
204
205
206
207
208
60
60'
66
67
68
69
A
B
C
D

FIG.14.
FIG.10.
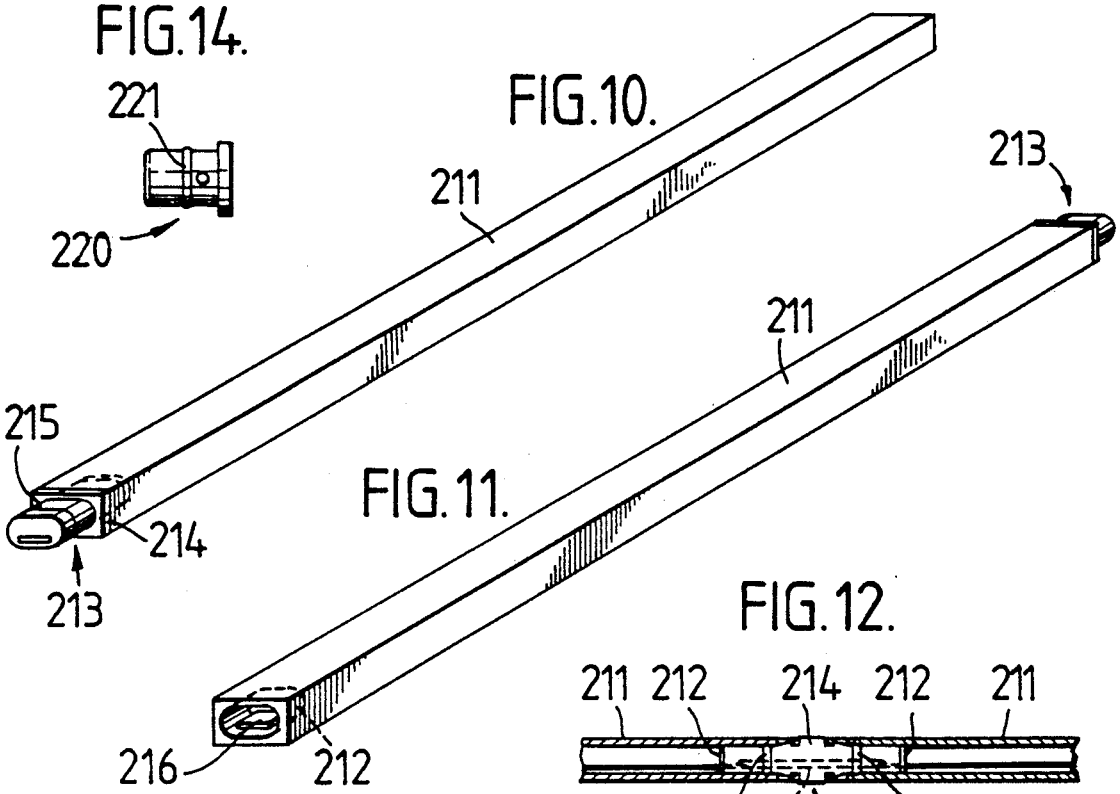
FIG.11.
FIG.12.
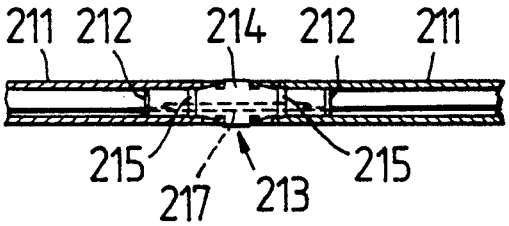
FIG.13
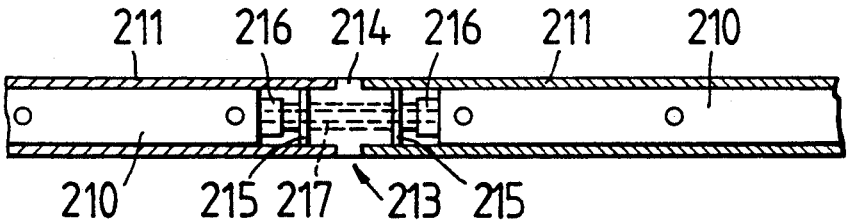
FIG.15.
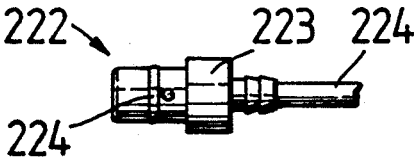
FIG.16.
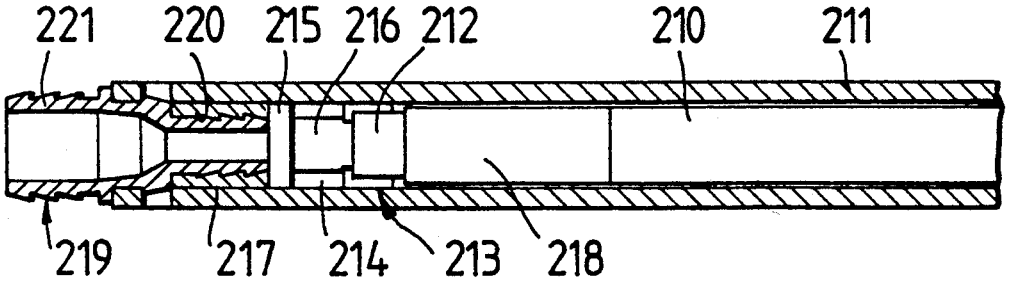

LIGHTING SYSTEM

RELATED APPLICATION

This application is a continuation-in-part application to U.S. Ser. No. 328,455 filed on Mar. 24, 1989, U.S. Pat. 4,994,944, the disclosure of which is incorporated herein by reference.

FIELD AND BACKGROUND OF THE INVENTION

This invention relates to a lighting system which enables elongate lengths of illumination to be provided for a wide range of decorative, safety and other applications.

Linear lighting systems used hitherto have generally been in the form of extruded tubing of a resilient, translucent or transparent material, e.g. extruded plastics tubing. The tubing is illuminated by a series of bulbs connected together by electric wiring to form an elongate lighting string which is threaded through the tubing to provide an internal illumination means therefor. The tubular strip is then located where desired to provide an elongate lighting system for decorative or safety purposes. For example, a length of such illuminated tubing may be provided in a non-slip nosing across the front edges of the steps of a staircase. The lighting system may be used in flooring systems e.g. at a junction between different types of flooring or floor covering. It may be provided as a decorative embellishment e.g. on walls, or display systems, or along bar pelmets, wherever a decorative pencil-line of light is desired. When resilient tubing is used, the lighting system may follow nonlinear paths, e.g. wound as a shallow spiral around columns or pillars.

However these previously known systems have certain technical and practical disadvantages. First of all, a length of the wiring incorporating the spaced apart illuminating elements does not provide a standard predictable length thereof owing to the flexibility of the wire connectors of the illuminating device which are soldered to the intermediate lengths of connecting wiring. Over a relatively long stretch there can be a very significant expansion or contraction of a supplied length of the illumination wiring resulting in a discrepancy with the length over which the illumination is required to extend. The illumination wiring which is usually stored on a roll, is relatively brittle owing to the soldered wire connectors associated with the illuminating devices, which are free to bend.

In practice, it is necessary to measure up on site the required extent of the linear illumination and then to order the required length which is cut by the supplier from a storage roll thereof. As stated above, the length when fitted on site may not match the requirement due to expansion or contraction of the supplied length. Moreover electrical connections have to be made on site, e.g. by soldering, to incorporate resistors in the system to control the voltage supplied to the illuminating devices, and to connect voltage supply lines, as well as to make any other necessary circuit connections.

U.S. Pat. No. 4,654,765 teaches an elongate lighting assembly which can be produced from insulated strips having electrical conductors thereon. The light bulbs are connected in parallel between the voltage supply lines. This specification is concerned with a method of mounting the bulbs on the strips in an easily replaceable fashion. This system therefore utilizes an entirely parallel arrangement of the light bulbs on a set of similar length strips so that the full supply voltage is applied to each light bulb, which in some applications prevents the use of relatively low voltage bulbs. Moreover it may be necessary to sever one or more of the strips to accommodate required lengths of illumination and then to electrically and mechanically connect the severed portions which can be relatively cumbersome on site.

U.S. Pat. No. 4,607,317 discloses connectors for connecting together elongate lighting circuits to form a linear strip. However each module is of the same length and requires to be cut at specific marks in order to tailor the lighting assembly to specific requirements. This limits the particular lengths which can be accommodated and makes for a relatively cumbersome procedure on site.

U.S. Pat. No. 3,755,663 discloses a display device comprising miniature lamps connected in series to form substrings which are coupled in parallel between a pair of parallel supply conductors. This assembly is then slidably inserted in a transparent flexible tube. The tube can be cut as desired but only between the substrings. This again limits the particular lengths which can be accommodated and the overall system is relatively cumbersome to assemble and to adapt to specific requirements on site.

SUMMARY OF THE INVENTION

The invention seeks to provide an improved linear lighting system in a modular form capable of enabling a variety of different lengths of elongate lighting strips to be assembled in a relatively quick, easy and convenient manner.

The invention provides a lighting system including a plurality of modular components, each comprising an elongate strip of a finite length, supporting or incorporating an elongate lighting circuit extending along the strip and connector means for engaging juxtaposed ends of said strips to connect the strips end to end and to electrically connect the lighting circuits thereof to form a continuous electrical lighting circuit which extends along the length of the strips, when connected end to end as aforesaid, and which is adapted to provide an electrical connection for applying a voltage across a plurality of illuminating devices to be mounted on the strips at predetermined spaced locations along the length of said continuous electrical lighting circuit.

Embodiments of the invention provide a lighting system including a plurality of modular components comprising a plurality of elongate strips of different finite lengths, each strip including an elongate lighting circuit extending along the strip, which lighting circuit provides at least one pair of voltage supply lines extending along the length of the strip and at least one electrical connecting line for connecting at least one illuminating device in parallel between said at least one pair of voltage supply lines, said lighting circuit of at least one of said strips being adapted to connect at least one predetermined resistor in series with said at least one illuminating device thereof so that the total electrical resistance of said at least one illuminating device and said at least one resistor of each of the strips is substantially the same to provide a set of voltage compatible elongate strips.

In some embodiments, a plurality of said electrical connecting lines may be provided on each of said strips.

In other embodiments, a pair of ring voltage supply lines may be provided to reduce voltage drop along a set of said strips electrically connected in series with one another.

In further embodiments, at least one control electric line may be provided to supply control signals to control different possible functions of operation of said electric lighting circuit.

In further embodiments, each of said strips may be sealed within an outer tubular housing.

Each of said strips may be in the form of a printed circuit board.

The aforesaid connector means may comprise at least one connector member for location between a pair of adjacent strips and having means for resiliently gripping each of said juxtaposed ends of the strips, and means for making an electrical connection between the adjacent ends of said elongate electrical lighting circuits associated with the strips.

A lighting system according to the invention may include a voltage supply connecting means for supplying a voltage to said continuous electrical lighting circuit at one or both ends thereof, said voltage supply connecting means comprising a terminal portion adapted to be resiliently gripped by a connector member as aforesaid which is to be resiliently engaged with one end of one of said strips, and having electrical connecting means for making an electrical connection between the electrical connection means of that connector member and a voltage supply.

A lighting system according to the invention may include flexible connecting means for electrically connecting a pair of strips which can be set at different angular positions with respect to one another, said flexible connecting means comprising connector portions each adapted to be resiliently gripped by a respective one of a pair of said connector members which are to be resiliently engaged with adjacent ends of said pair of strips, respectively; flexible means connecting said connector portion; and electrical connecting means for making an electrical connection between the electrical connection means of said pair of connector members.

A lighting system according to the invention may further include an elongate tubular container having a translucent or transparent wall or wall portion, for receiving said plurality of elongate strips when connected by said connector means.

Said tubular container may have a removably mounted wall section extending along its length.

Said tubular container may comprise an elongate base channel-section strip, and an elongate, translucent cover strip which can be removably engaged with the base strip to close the channel-section thereof.

Interengageable snap fastening means may be provided on said base strip and said cover strip.

Said base strip may be made of a resilient electrically insulating material. In other embodiments, the base strip may be metallic and relatively rigid, with an internal lining of an electrically insulating material provided to isolate said lighting circuit from the metallic base strip.

A plurality of base strips and cooperating cover strips which can be secured together may be provided to form required lengths thereof. Gasket means may be provided for effecting waterproof joints between adjacent base and cover strip combinations.

BRIEF DESCRIPTION OF THE DRAWINGS

Embodiments of the invention will now be described by way of example and with reference to the accompanying drawings, in which:

FIGS. 10 and 11 are, respectively, diagrammatic perspective views of opposite ends of a modular component of a further embodiment of a lighting system in accordance with the invention;

FIGS. 12 and 13 are, respectively, diagrammatic side and plan details of a pair of the modular components of FIGS. 10 and 11 connected end-to-end;

FIG. 14 is a side view of an end plug for the system of FIGS. 10–13;

FIG. 15 is a side view of part of a flexible coupling device for the system of FIGS. 10–14;

FIG. 16 is a diagrammatic cross-section of a tubular housing module of a further embodiment;

DETAILED DESCRIPTION OF SPECIFIC EMBODIMENTS

Figure 1:
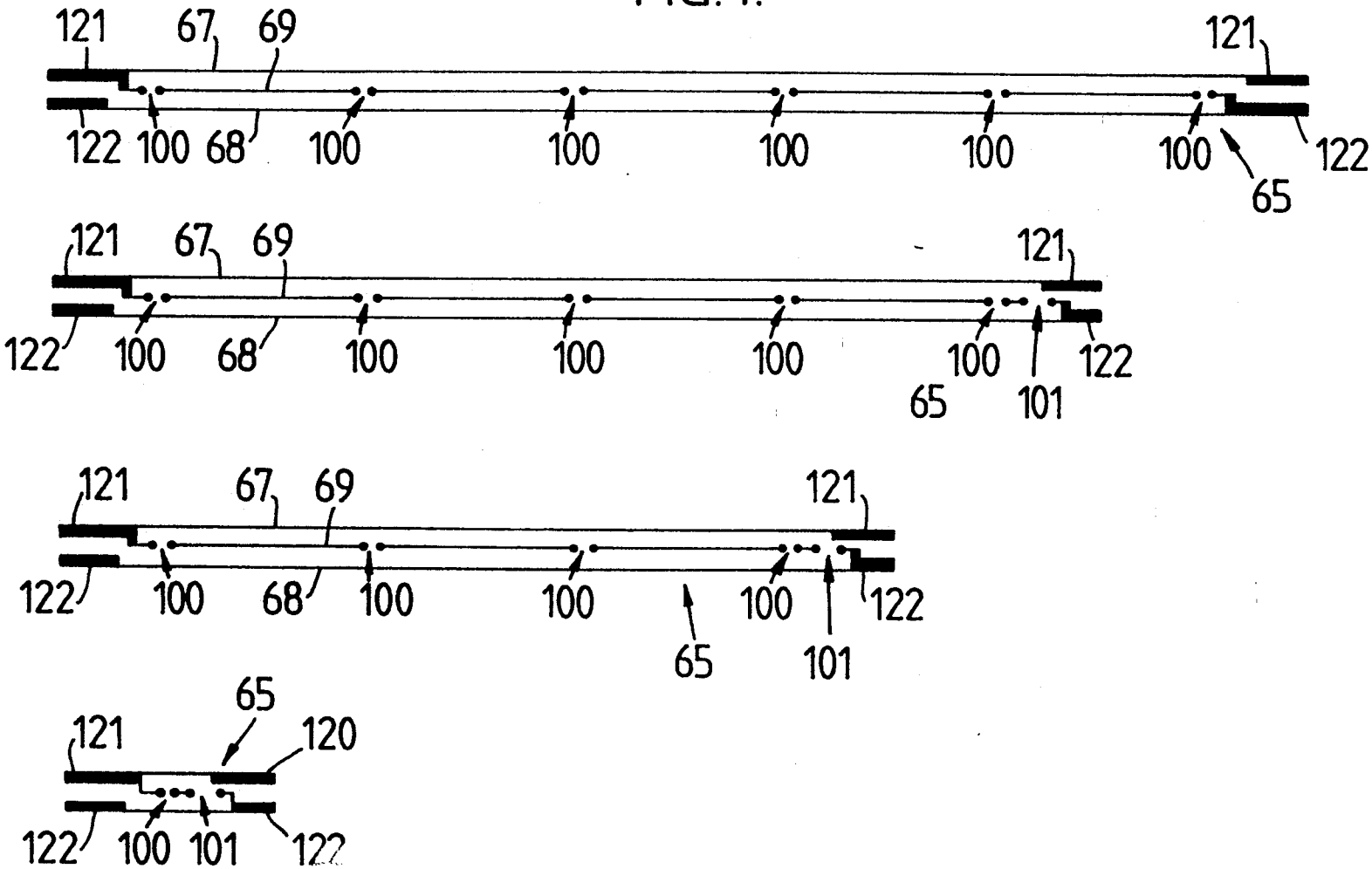
FIG. 1 is a plan view of a series of lighting circuit boards of a lighting assembly as illustrated in EP-A-0,336,601.
Figure 2:
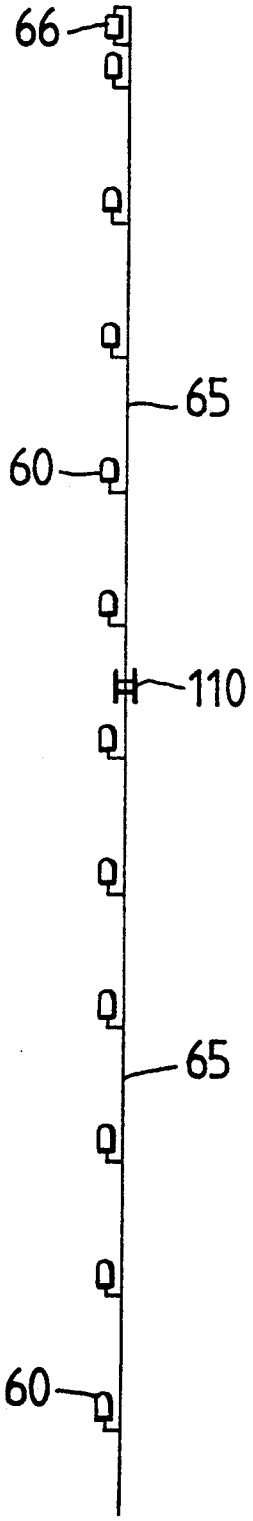
FIG. 2 is a side view of a pair of interconnected circuit boards of the type as shown in Figure 1 having electrical components, including illuminating elements, located thereon.

FIG. 1 illustrates a lighting system comprising a set of a number of different length, flexible, circuit boards on each of which the electric circuitry is arranged to provide a series connection between the lamp elements. Each circuit board (65) has two voltage supply lines (67,68) and an electric line (69) connected in parallel across the voltage supply lines (67,68), which connects in series the lamps associated with that board and any compensating resistor. The system illustrated in FIG. 1 comprises four different, finite lengths of circuit board, having circuitry for mounting six, five, four and one lamp, respectively, at regularly spaced positions (100). When less than six lamps are used on a circuit board, an appropriate resistor is generally mounted at a position (101) in order to make all the circuit boards in the set voltage compatible with one another whereby the resistance of the series connected elements is the same for each circuit board of the set. Generally lamps or LEDs (60) of the same voltage rating are used throughout, although this is not essential. Whatever illuminating devices (60) are used, appropriate resistors (66) (see FIG. 2) are used to make all the circuit boards in the set voltage compatible with each other and with the desired supply voltage.

Furthermore different sets of standard circuit boards can be provided having different spacings between the location positions of the lamps for any linear length of illumination constructed by coupling the appropriate number and size of circuit boards end to end using coupling elements described below. Examples of such spacings are 50 mm, 75 mm and 100 mm. However in other constructions irregular spacings may be selected for special effects.

In order to assemble required linear lengths of the light system from an appropriate number and size of circuit boards in the set, coupling elements (110) as illustrated in FIGS. 3A–3E are used. Each coupling element (110) comprises an outer housing (111) comprising an upper part (112) and a lower part (113) snap fitted together. Each housing part (112,113) comprises an oblong tray-like member having upstanding peripheral wall portions with resilient pegs (114) provided on abutting edges of the wall portions of the two housing parts (112,113) to engage in corresponding apertures in the opposite abutting edges to provide a snap connection means for the two housing parts, which are disposed in inverted positions with respect to one another.

Figure 3A:
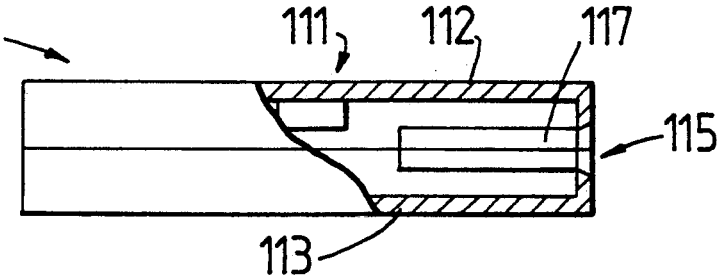
FIGS. 3A–3E illustrate a coupling element for circuit boards of FIG. 1 and comprise respectively a side view partly in cross section of the coupling element, a plan view partly in cross section of the coupling element; a cross-sectional view of an upper portion of the coupling element; an end view of the upper portion of the housing of the coupling element; and a side view of one electrical connector element of the coupling element.
Figure 3B:
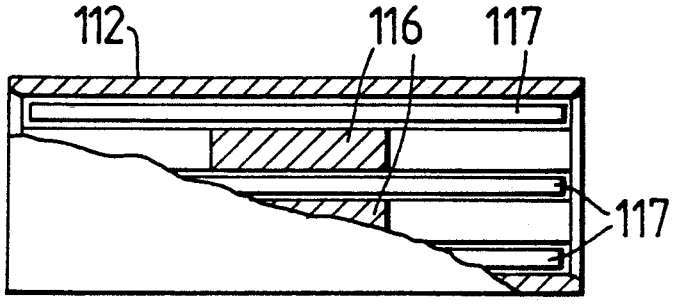
Figure 3C:
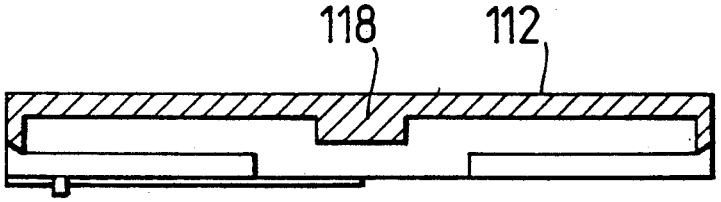
Figure 3D:
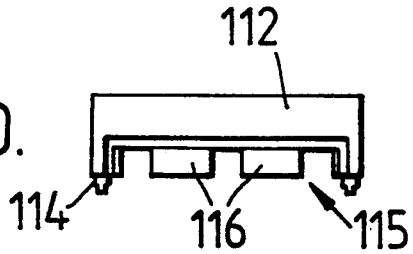
Figure 3E:
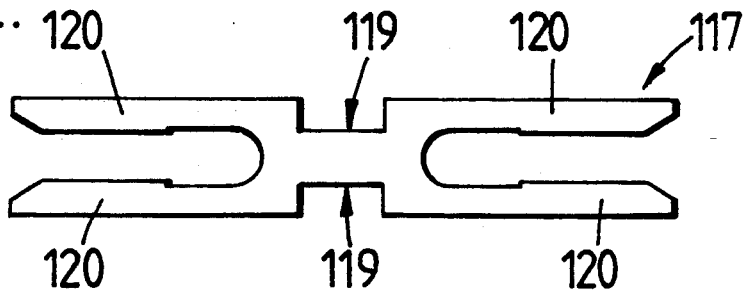
Figure 4A:
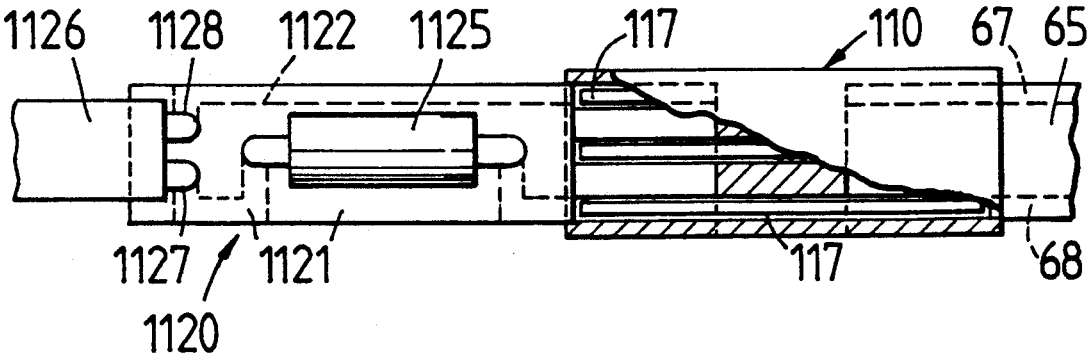
FIGS. 4A–4D are, respectively, a plan view partly in section; a side view partly in section; a circuit diagram; and a diagrammatic perspective view of a voltage supply connector device.
Figure 4B:
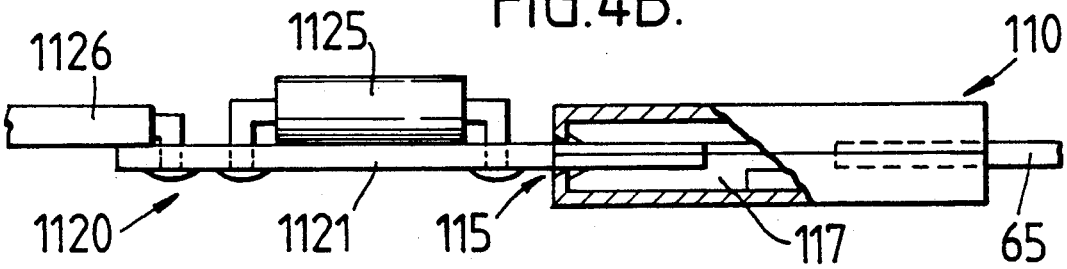
Figure 4C:
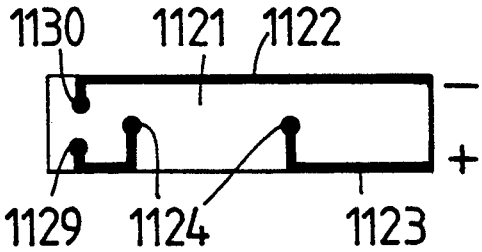
Figure 4D:
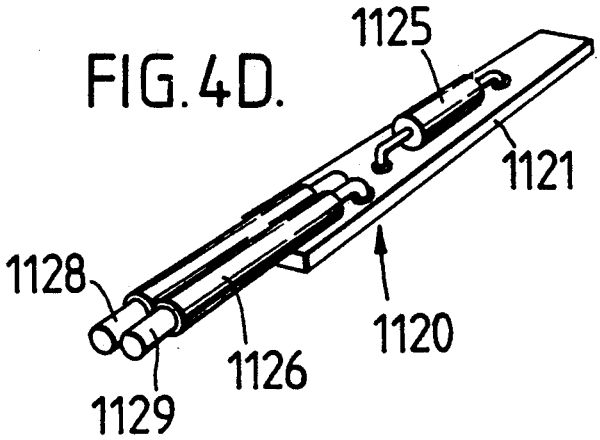

The end walls of the housing parts (112,113) are recessed to provide an entry slot (115) for receiving end portions of two circuit boards to be joined end to end by the coupling element (110). Within each housing part (112,113), there are two longitudinally extending dividing walls (1116) for laterally spacing apart three plate-like electrical connecting elements (117), as illustrated in FIG. 3E within the housing (111). Three location formations (118) of oblong cross section are integrally formed between the dividing walls (116) and the longitudinal side walls of the parts (112,113) for engagement in centrally located recesses (119) in the connecting elements (117). Each connecting element (117) has, at each end, a pair of resilient forks (120) for making electrical connections with the circuitry provided on the circuit boards (65).

Therefore selected pairs of circuit boards (65) can be joined by using a respective coupling element (110). An end portion of each board is engaged in the slot (115) at a respective end of the housing (111). The pairs of forks (120) make gripping engagement with the end portion of the circuit board and electrical contact with the respective voltage supply line terminals (121,122) at the end of the circuit board. The voltage supply lines of the pairs of circuit boards (65) so connected by respective coupling elements (110) are thereby electrically connected to each other. A simple coupling and electrical connection is thereby achieved by merely pushing end portions of the circuit boards (65) into opposite ends of the coupling element (110). It will be noted that only two electrical connecting elements (117) are employed in operation with the central element (117) being redundant. However with other possible circuit arrangements on the circuit boards, three connecting elements (117) are sometimes required.

It will be appreciated that the series connected lamps of each electric circuit of a series of circuit boards (65), when connected as described above by coupling elements (110), are connected in parallel with the series connected lamps associated with each of the other circuit boards in the set. This is termed a "series-parallel" circuit arrangement.

Referring to FIGS. 4A–4D, a voltage supply connector element (120) is provided for coupling to one end of a linear series of circuit boards (65) joined together by coupling elements (110). The connector element (120) includes a terminal portion provided by a short strip of circuit board (1121) having a circuit track arrangement, as illustrated in FIG. 14C, provided thereon. The circuit track comprises a negative electric line (1122) and a positive electric line (1123) which has connector points (1124) for connection therein, e.g. by soldering, of a fuse (1125). A supply cable (1126) has positive and negative feed wires (1127,1128) which are connected by soldering to positive and negative terminal connector points (1129,1130) on the circuit board (1121). The free end portion of the circuit board (1121) is inserted into a slot (115) of a coupling element (110) located at the end of a circuit board (65) disposed at one end of the linear series thereof. The outer pair of electrical connecting elements (117) of the coupling element make electrical contact with the positive and negative lines (1123,1122), on the circuit board (1121) to connect the supply voltage across the voltage supply lines (67,68) on the circuit board (65), to provide the voltage supply of the lighting system.

Figure 5A:
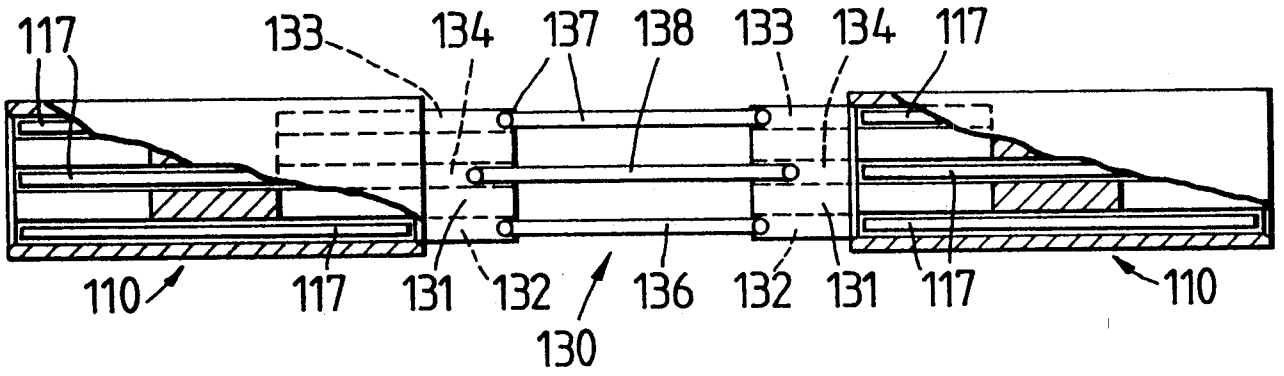
FIGS. 5A–5C are, respectively, a plan view, partly in section; a side view partly in section; and a circuit diagram of a connector portion, of a flexible connector device for the connecting circuit boards of FIG. 1.
Figure 5B:
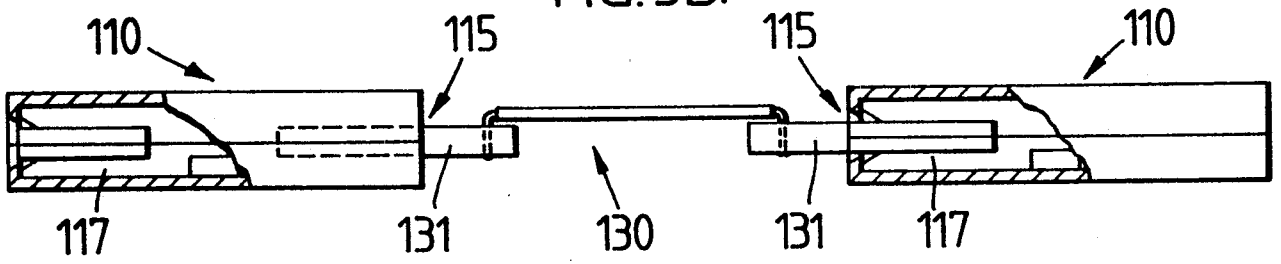
Figure 5C:
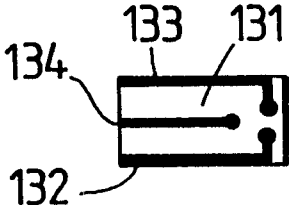
Figure 7A:
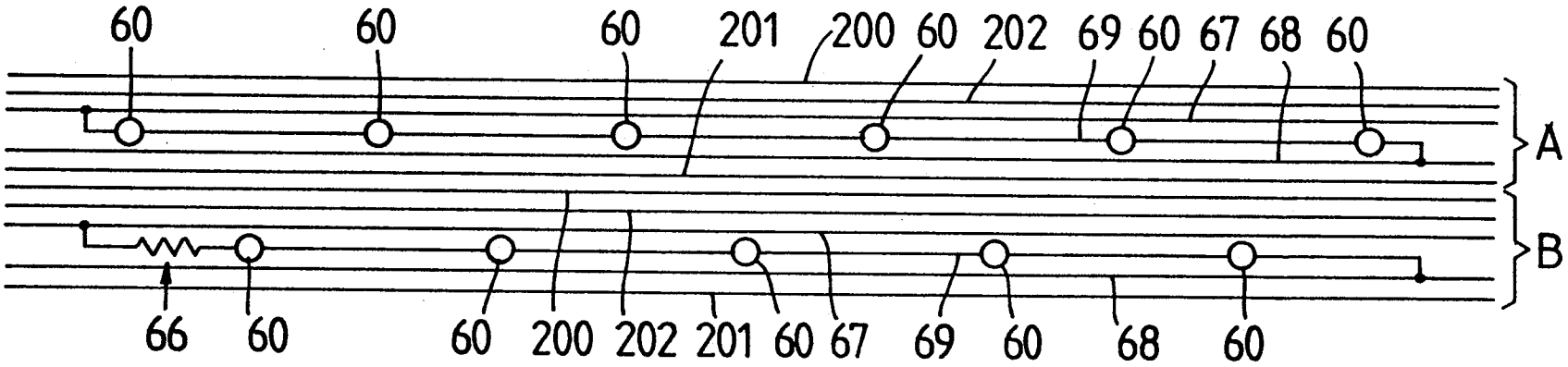
FIGS. 7A–7F illustrate schematically circuit diagrams of respective lighting circuit boards of a second embodiment of the invention.
Figure 6A:
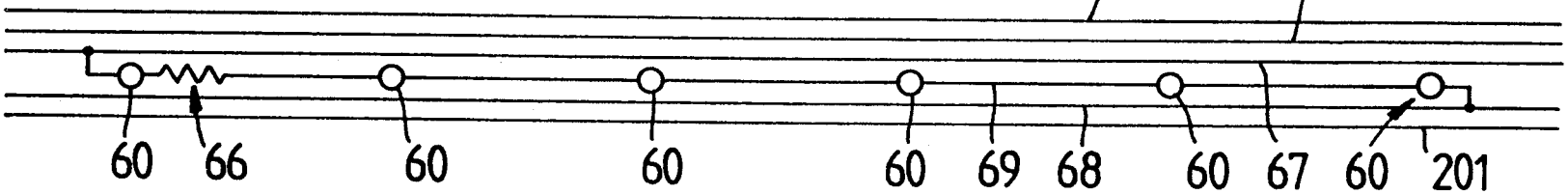
FIGS. 6A–6F illustrate schematically circuit diagrams of respective lighting circuit boards of a lighting system according to a first embodiment of the present invention.
Figure 7B:
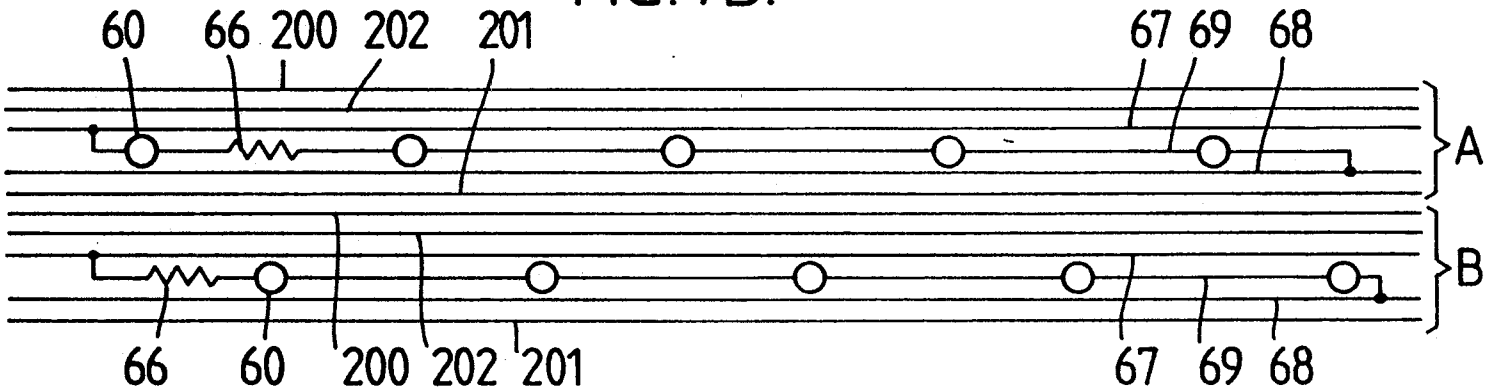
Figure 6B:
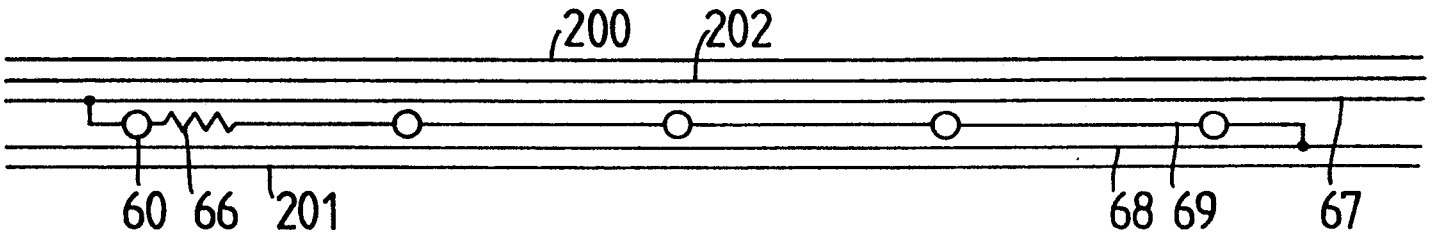
Figure 7C:
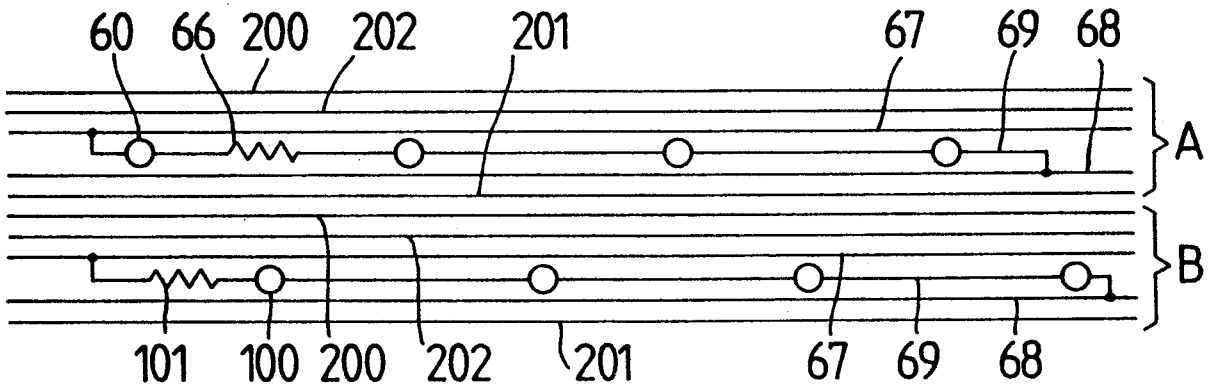
Figure 6C:
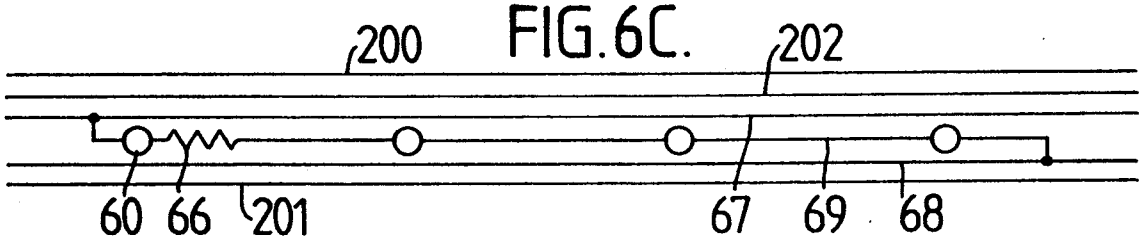
Figure 7D:
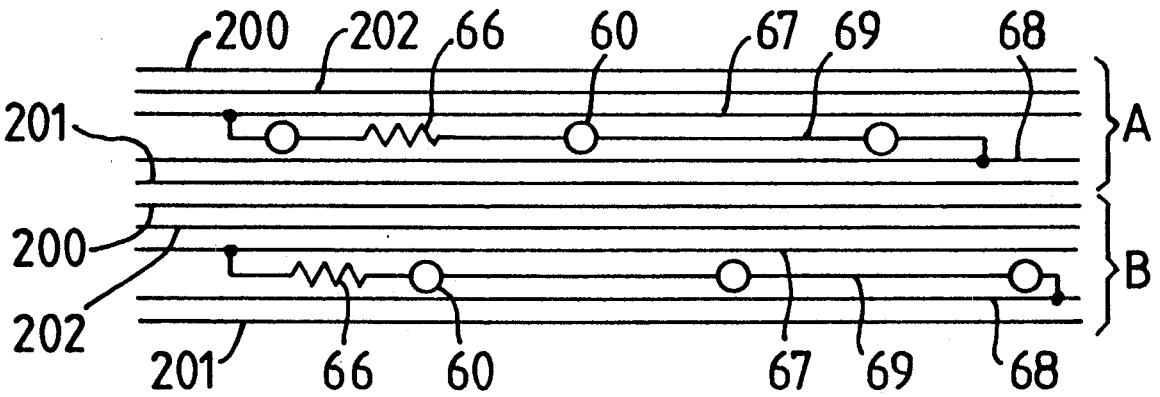
Figure 6D:
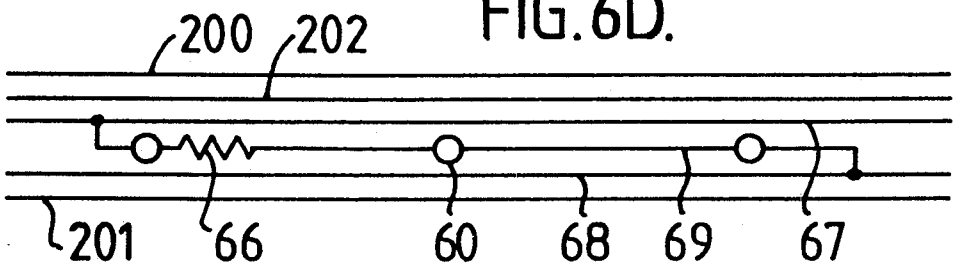
Figure 7F:
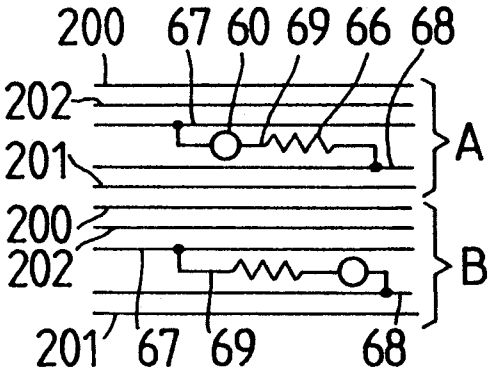
Figure 6F:
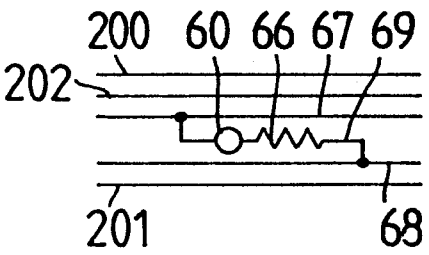
Figure 7E:
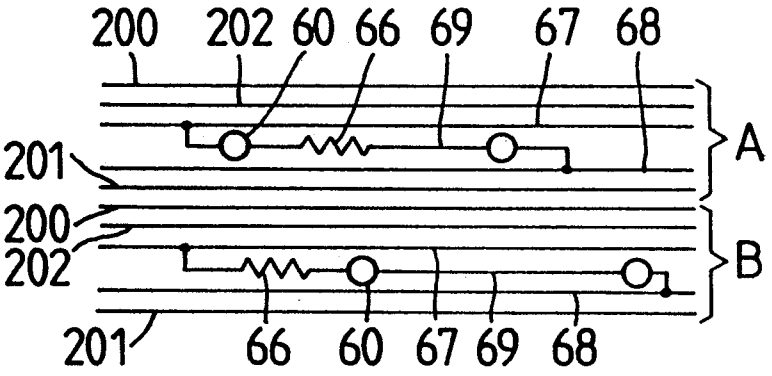
Figure 6E:
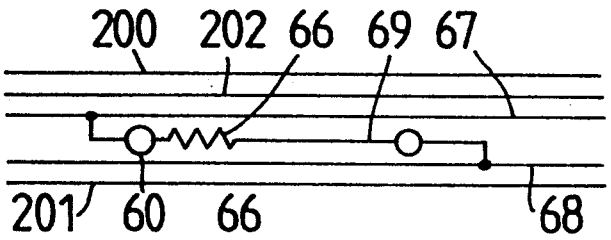
Figure 8A:
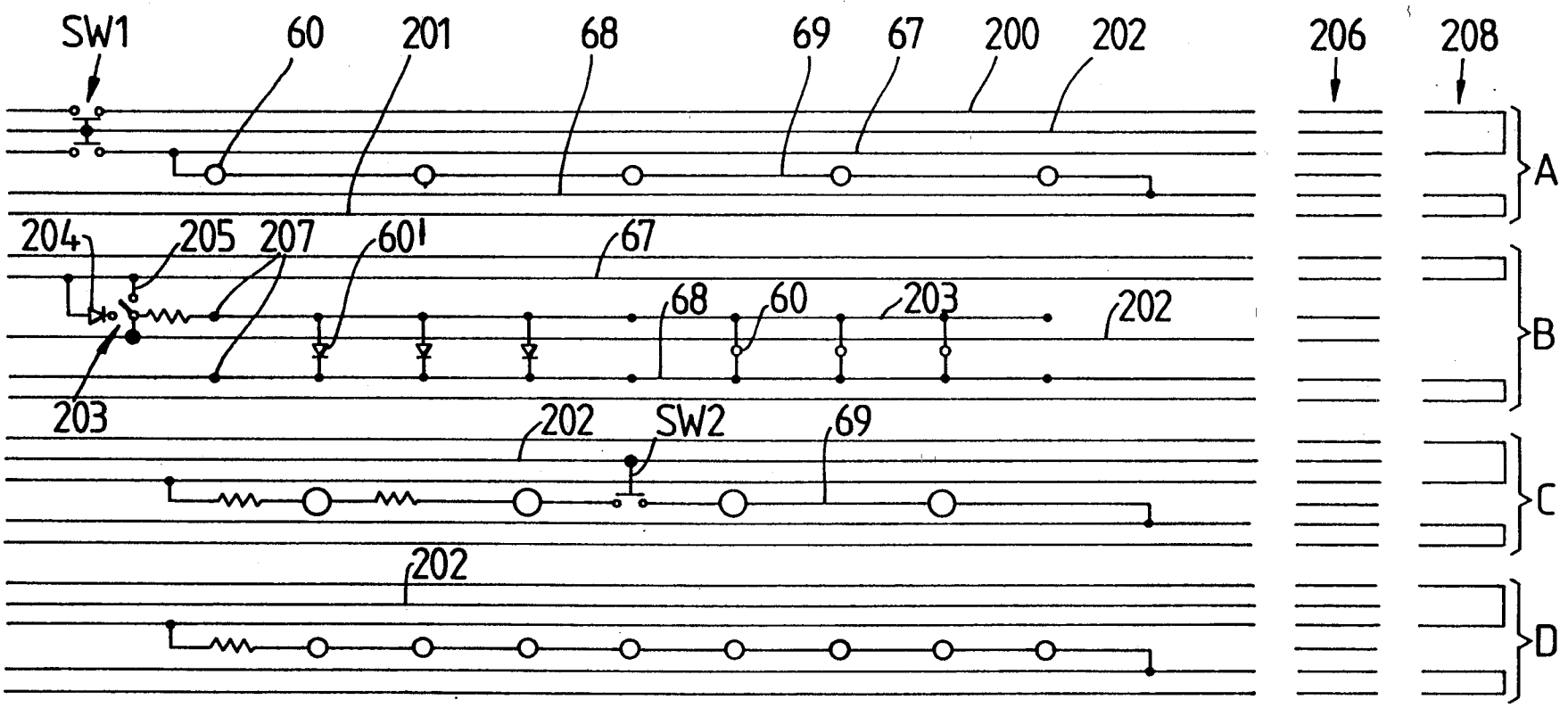
FIGS. 8A–8I illustrate schematically circuit diagrams of respective lighting circuit boards of a third embodiment, each Figure also including a schematic illustration of a circuit diagram of a circuit board connector element and of an end connector element for an assembled series of the circuit boards.
Figure 8B:
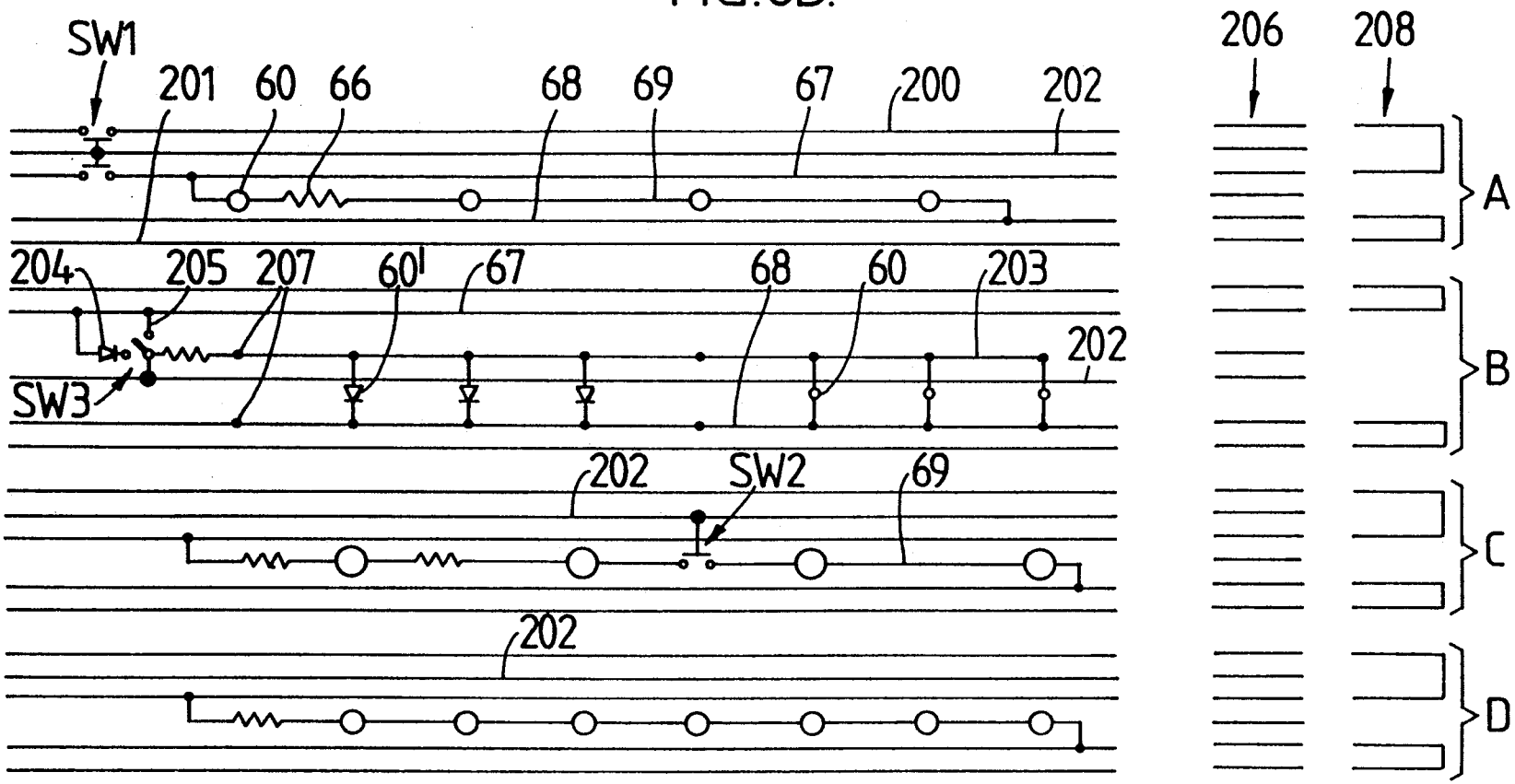
Figure 8C:
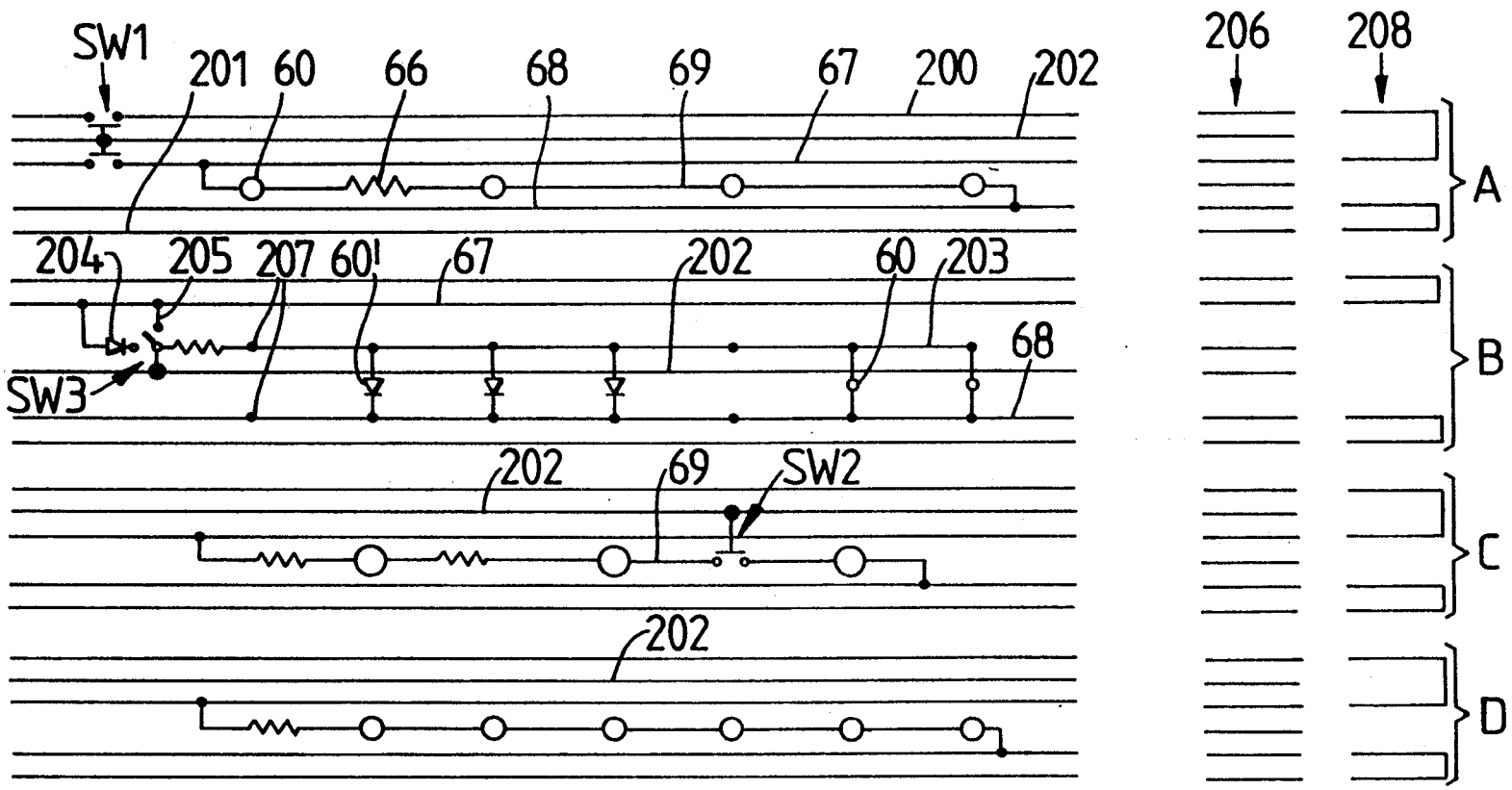
Figure 8D:
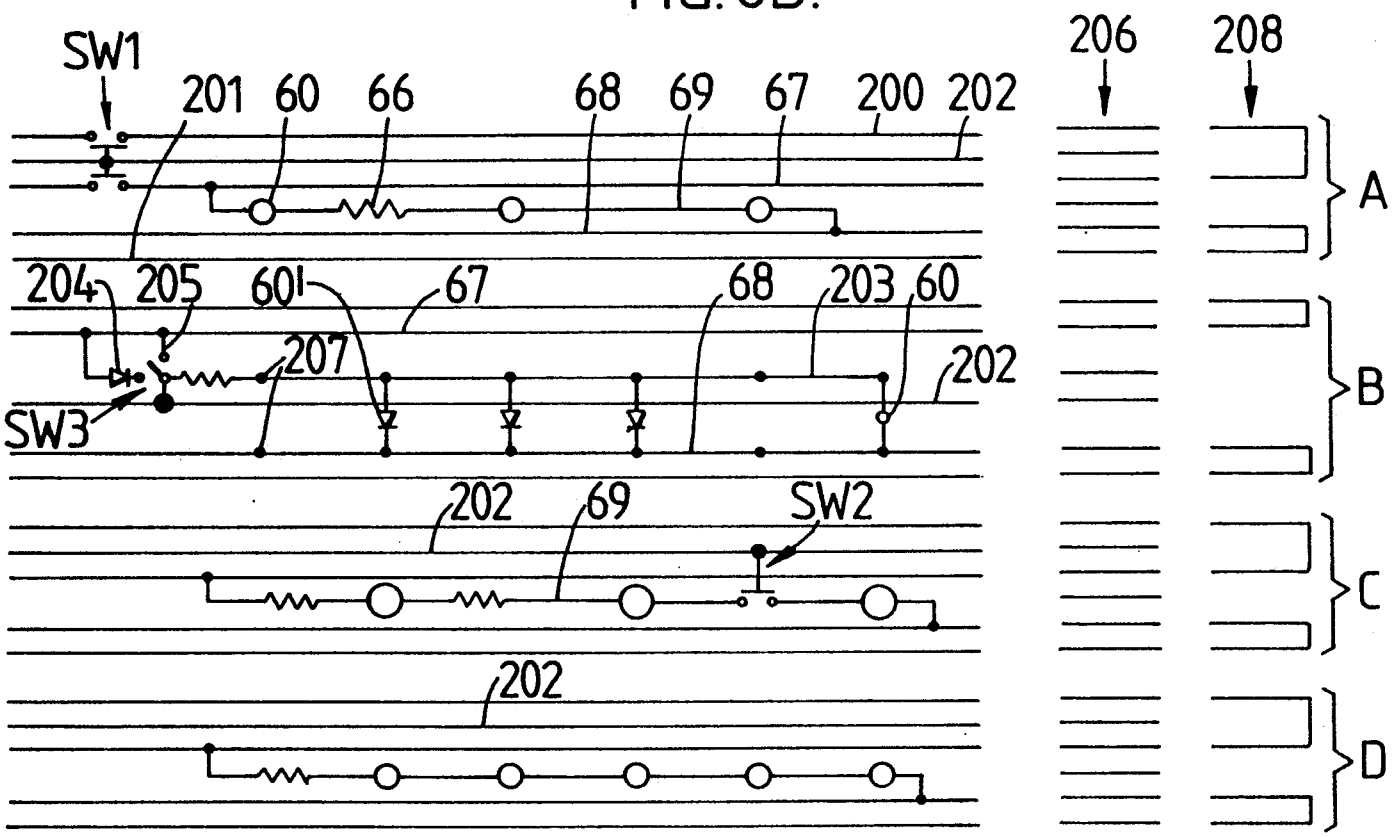
Figure 8E:
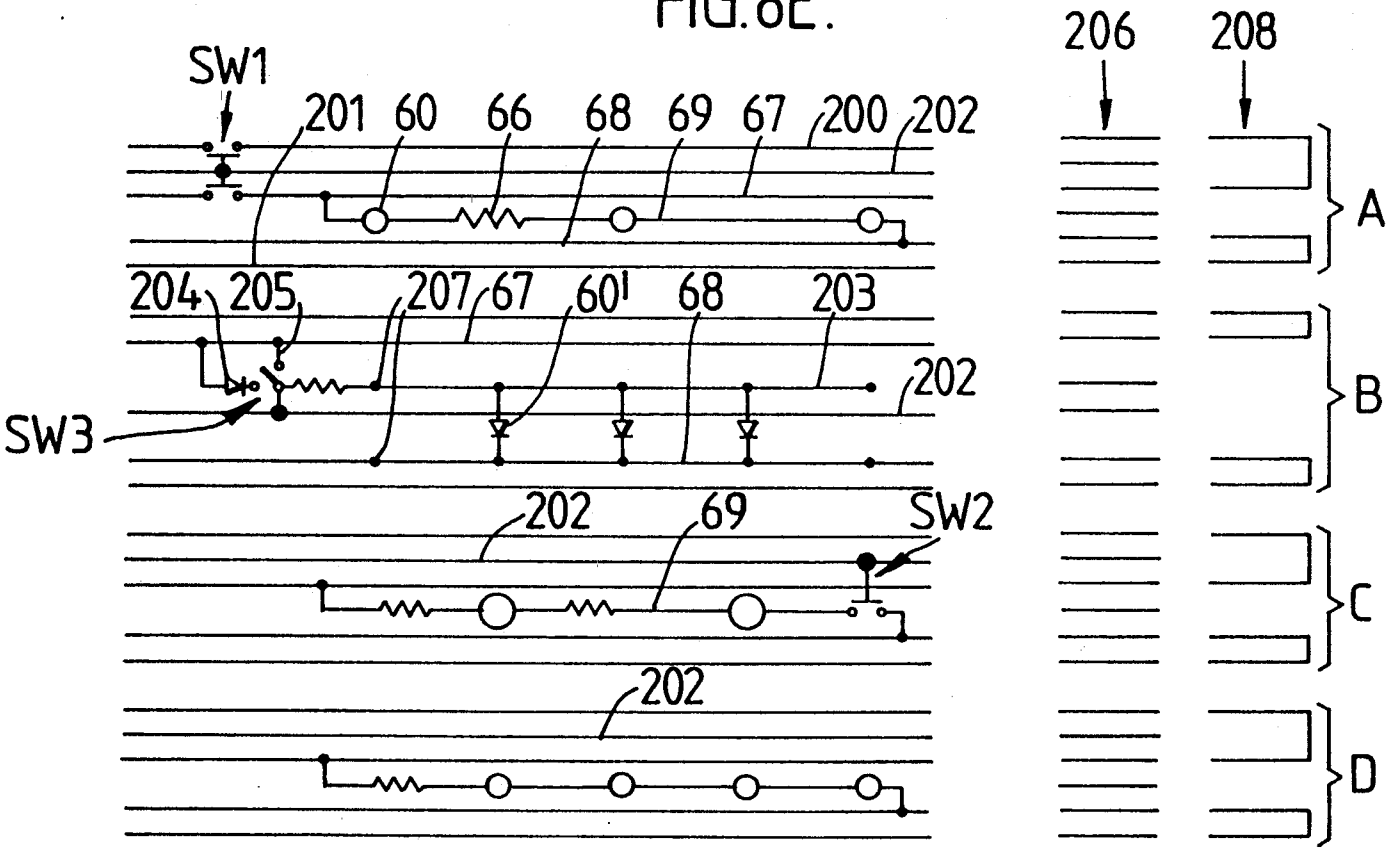
Figure 8F:
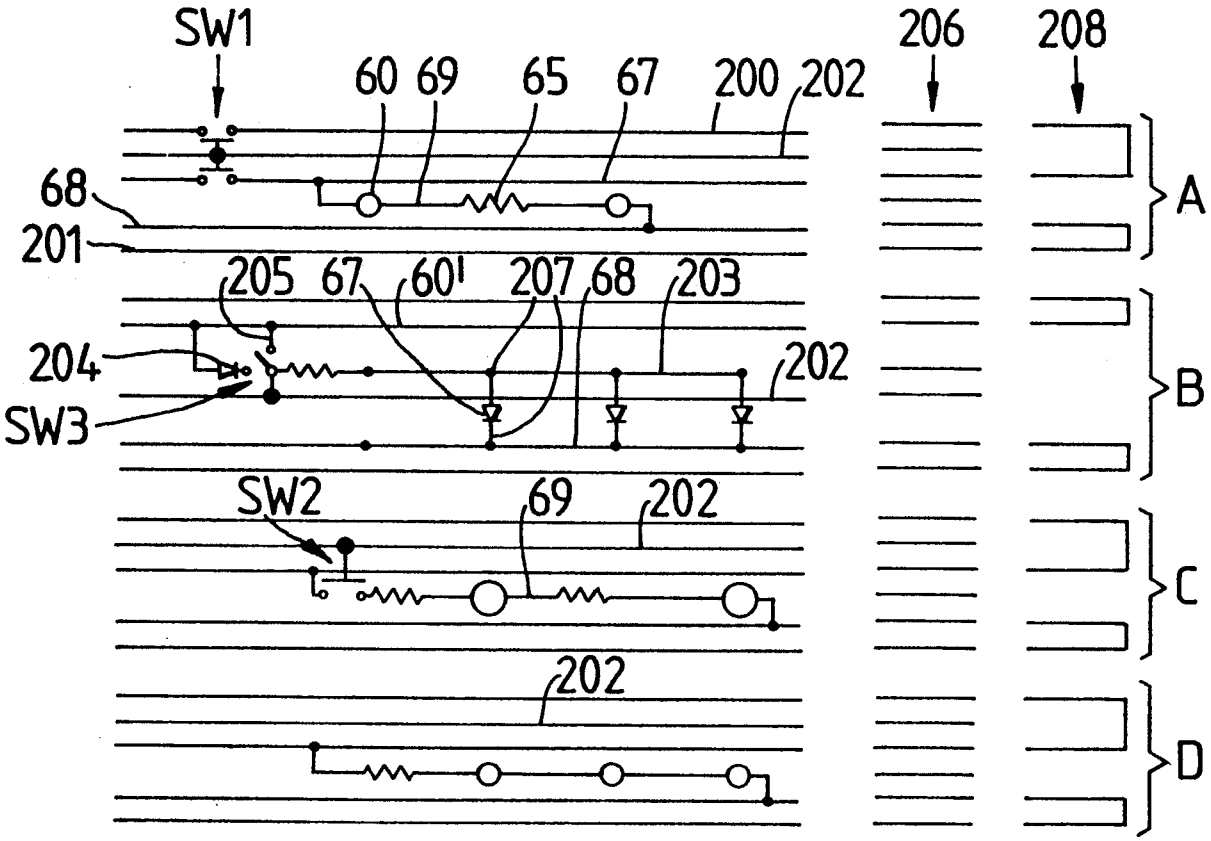
Figure 8G:
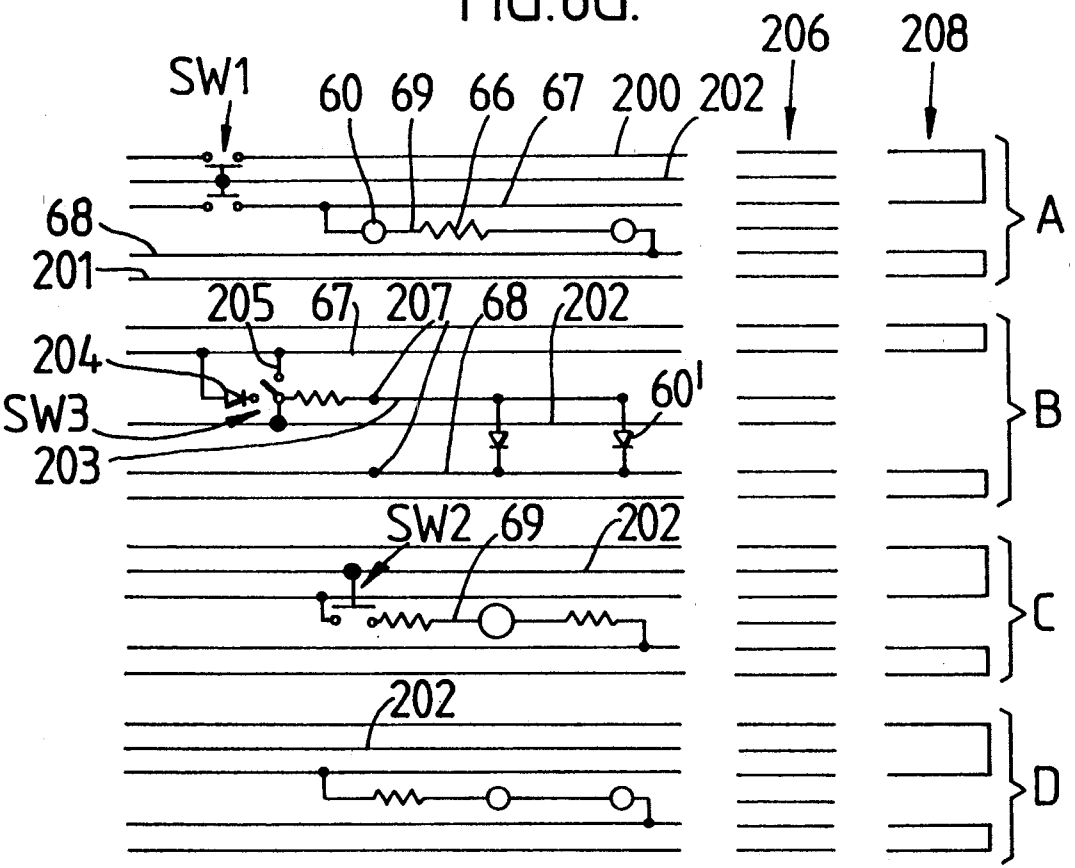
Figure 8I:
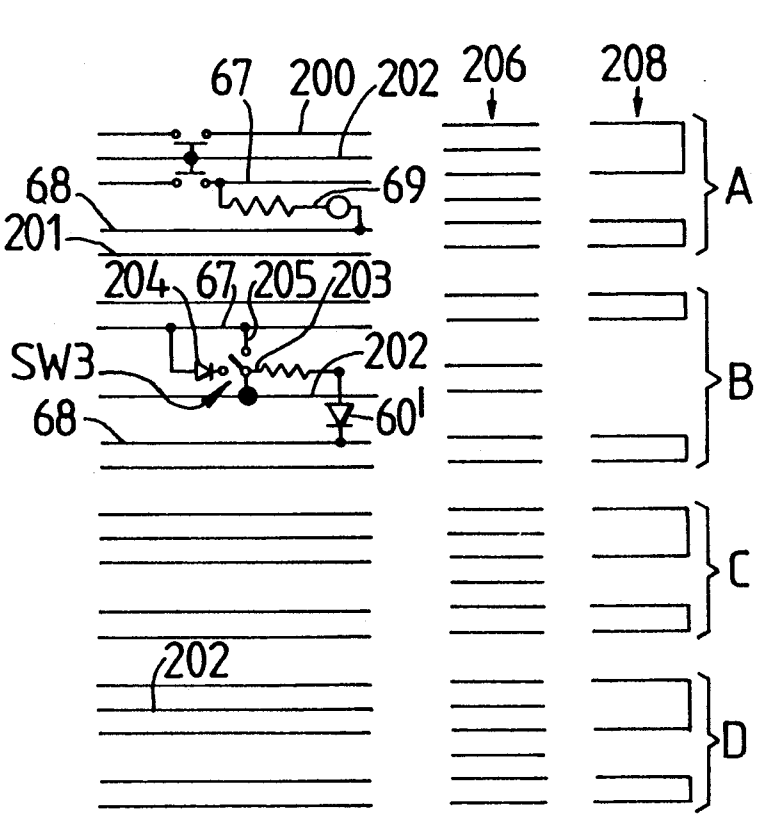
Figure 8H:
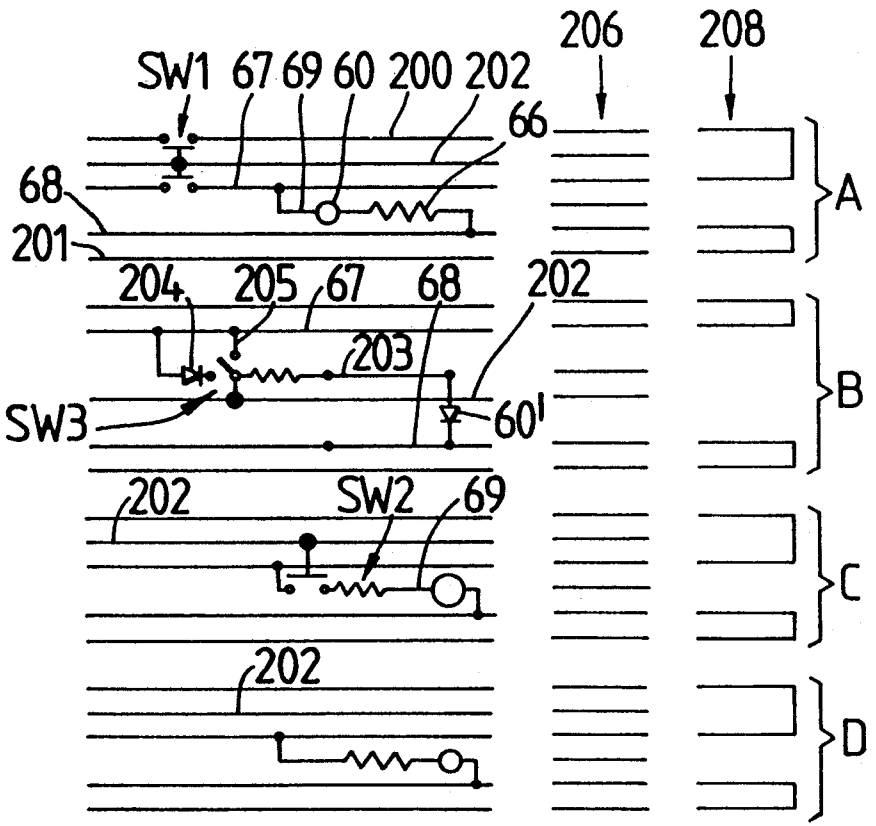

Referring to FIGS. 5A–5C, there is shown a flexible connecting device (130) for allowing the connection of adjacent circuit boards in a series thereof, which boards may be set at different angular positions relative to one another. The device (130) comprises a pair of similar connector portions (131) made of a short strip of circuit board having a circuit provided thereon, as illustrated in FIG. 5C, consisting of three electric lines, i.e. positive line (132), a negative line (133) and a central line (134). The connector portions (131) are joined by flexible jumper wires (136,137,138) which electrically connect the positive lines (132), the negative lines (133) and the central lines (134) on the connector portions (131).

If a lighting system according to FIG. 1 is required to fit around three sides of a rectangular structure, the overall length is measured and the required set of components selected, as described above, for coupling together to form the lighting system. Circuit board (65) can be cut to fit around each corner with the cut pieces then being coupled together using flexible connector devices (130). Firstly, coupling elements or devices (110) are engaged with the cut ends of the circuit board (65). Then, the connecting portions (131) of a connector device (130) are engaged in the open slots (115) of the respective coupling devices (110). The flexible jumper wires allow the cut sections of the circuit boards (65) to be located along different sides of the aforesaid structure.

In such arrangement, the voltage supply lines (67,68) of the two parts of the severed circuit board (65) are connected by the jumper wires (136,137) and the series connection lines (69) are connected by the jumper wire (138).

For a person who is particularly skilled with the system, it would be possible to select a set of circuit boards (65) which fit precisely the lengths along each side of the rectangular structure without any need for cutting any of the circuit boards (65). The same coupling devices (110) and flexible connector devices (130) are utilized at the corners, but in this arrangement the central jumper wire (138) is redundant in operation.

When the modular components of a lighting system according to the invention are connected to extend over relatively long lengths, voltage supply connectors may be connected to both ends of the electrically coupled series of circuit boards (65) to maintain the voltage along the entire length of the system.

As stated above, different standard sets of circuit boards as illustrated in FIG. 1 may be made available, each set having a different spacing between the lamps. In order to facilitate use of a "series-parallel" lighting system according to the invention, a set of calculation charts are preferably provided for each set of circuit boards for operation at a predetermined supply voltage and using illuminating devices of a predetermined operating voltage. The charts give a concordance between the number of lamps required, at the preselected spacing therebetween, for any length as measured on site. A further concordance chart then gives the required number of circuit boards of the different lengths in the set for that length in dependence on the number of lamps required. It is therefore a simple matter, on site of measuring the required length of linear illumination required, and from that determining from the concordance charts the required different length circuit boards and the number thereof, which are then removed from the set and coupled together very simply using the required number of coupling elements (110). The linear lighting system is then completed by connecting at one end of the linear series of joined circuit boards (65) a voltage supply connector element.

The "series-parallel" arrangement is advantageous because the lamps required are of lower rated voltages so that a greatly reduced current flow, e.g. one quarter the current of a similar parallel arrangement, is present in operation of the system. This provides a safer system which is generally more compact because lower rated, and therefore smaller components, are needed. A specific example of a practical system according to the invention is designed to operate at 24 V (AC or DC) with lamps of 5 V for a "series-parallel" arrangement, and a maximum current flow of 3 amps.

A lighting system according to the invention would normally be supplied as a kit comprising standard finite length of flexible circuit boards and coupling elements allowing any required linear length to be built up from these components. The positioning of the lamps on the circuit boards, and the length of the coupling elements is such that, when a set of such boards are coupled in a linear series, the required predetermined spacing of the lamps along the entire linear length of the coupled boards is achieved. Furthermore, further boards may be provided for an end of any coupled series to accommodate a voltage supply connecting element whilst still maintaining the required predetermined spacing relationship between the lamps along the entire length of any coupled series of circuit boards.

Production of the above described circuit boards (65) may be carried out as follows. Each strip (65) may be, for example 50 cm long, 5 mm wide and 1 mm thick. Ten or twenty strips and copper tracking thereof can be formed side by side on a single substrate. A router may separate the individual strips leaving connecting pips therebetween. Alternatively no routing may be carried; instead the strips may be separated at a later stage by a multi-saw device. The lamps and resistors are then inserted on the upper sides of the strips with the terminal portions pushed through the strips to engage solder pads on the copper tracking formed on the underside of the strips. The terminals are cropped and soldered to those pads. The boards are then introduced into a defluxing bath where they are degreased and defluxed. They are blasted with lacquer or other insulating sealant in order to protect the copper tracking from oxidization. After the lacquer has dried the individual circuit boards are snapped apart and finished to remove the connecting pips or are separated by a multi-saw device.

FIGS. 6A–6F illustrate schematically an embodiment of the invention in the form of a lighting system comprising a set of printed circuit board elements of different finite lengths. This system is similar to the system illustrated in FIG. 1, the principle difference being that the elongate electrical circuits on the elements have been modified. The following description of this system will therefore be directed to those modifications. Similar parts have been given similar reference numerals.

The electric circuit of each voltage compatible PCB element in the set has, in addition to the pair of voltage supply lines (67,68) and the series-parallel line (69), a pair of ring circuit voltage supply lines (200,201) and a control signal/data line (202).

In order to assemble together a selected series of the circuit boards to form a lighting system for a particular application, coupling elements of the type illustrated in FIGS. 3A–3D may be used, as well as, when required, flexible connecting devices of the type illustrated in FIGS. 5A–5C. These coupling elements and connecting devices will be provided with additional electrical connecting elements, e.g. resilient forks (120) and jumper wires (136–138), to provide electrical connections between the respective ring circuit voltage supply lines (200,201) and the control signal/data lines (202) on adjacent strips connected thereby.

At one end of a selected series of circuit boards, a supply voltage is connected to the voltage supply lines (67,68) and the ring circuit voltage supply lines (200,201), e.g. by a voltage supply connector element of the general type shown in FIGS. 4A-4D, modified to have additional circuit supply lines and electrical connectors to connect also the two ring circuit voltage supply lines (200,201) to the supply voltage.

At the other end of the selected series of circuit boards, the positive and negative ring circuit voltage supply lines (200,201) are connected directly to the positive and negative voltage supply lines (67,68), respectively. This can be achieved by using an additional coupling element fitted onto the terminal circuit board of the series and having fitted in its opposite receiving section a small circuit board element having the required electrical bridging circuits provided thereon. Such an arrangement is illustrated in the embodiment of FIGS. 8A-8I. By providing ring circuit voltage supply lines directly on the circuit boards, this arrangement, therefore, provides a particularly convenient means of forming ring circuits to overcome unacceptable voltage drops which could occur in some practical applications.

The control signal/data line (202) provides a further facility to the system whereby control signal or data can be transmitted to control equipment positioned at selected locations along a lighting system assembled from a selected plurality of the circuit boards mechanically and electrically connected in an end-to-end relationship. For example switches may be incorporated in the electric circuits provided on the circuit boards themselves or ancillary equipment, e.g. external lights, sirens or other electrically or mechanically operated equipment having switch control means, and stationed near to the path of the electric lighting system. Such switches can be controlled by receiving specific signals, e.g. discrete specific electric voltages or pulses of discrete specific frequencies or infra-red signals, which can be transmitted along the control line (202) in order to operate the respective switches so as to produce a wide variety of special effects thereby adding further dimensions to the possible practical operations of a system according to the invention. Switches associated with external ancillary equipment can be electrically connected to the control line (202), e.g. by using a flexible connecting device of the type shown in FIGS. 5A-5C, between adjacent strip at the location of that equipment, and electrically connecting the switches to the jumper wire (136-138) associated with the control line (202) by splicing into that jumper wire an electrical connecting wire which is then connected to the control switch of the ancillary piece of equipment.

When the control line is used to control specific effects in the operation of the lighting system itself, then switches are incorporated in the electric circuits provided on the circuit boards. Such arrangements will be described in more detail hereinbelow, with reference to FIGS. 8A-8I.

Appropriate circuitry for supplying control signals from ancillary control apparatus to the control line (202) can readily be incorporated in a voltage supply connector (120) of the general type shown in FIGS. 4A-4D, as will be easily understood by persons skilled in the art.

It will be understood that in other possible embodiments of the invention the ring circuit voltage supply lines (200,201) or the control line (202) can be omitted for certain applications.

FIGS. 7A-7F illustrate schematically the electric circuits of a set of printed circuit board constituting another embodiment. This embodiment is similar to the embodiment of FIGS. 6A-6F and similar parts have been given similar reference numerals. The principle difference is that two separate lighting circuits (A,B) are provided on each circuit board. Each circuit comprises a set of six electric lines consisting of voltage supply lines (67,68), a series line (69) of illuminating devices, ring voltage supply lines (200,201) and a control line (202). The operation of the two circuits (A,B) are generally the same and in accordance with the embodiment of FIGS. 6A-6F.

The same or different voltage supplies may be connected to each circuit. For example if the same voltage is supplied to each circuit (A and B), e.g. from a common set of voltage supply lines (67,68), then additional resistance, by selection of resistors (66) in circuit (B), can be provided in each series-parallel line (69) in order to reduce the voltage in that line as compared to the supply voltage which is utilized in full in the series-parallel line (69) of circuit (A), so that illuminating devices (60) of different rated voltages can be accommodated in the respective circuits (A,B).

In such an embodiment, one circuit (A) can be used to provide light of high luminous flux value giving a high light output, e.g. for an emergency situation. The other circuit (B) can be used to provide a lower light output, e.g. to provide a pencil-line of light giving a permanent guide along a selected path to designate boundaries of such path or to indicate a path to be followed for various purposes.

It will be appreciated that in other embodiments of the invention based on the FIGS. 7A-7F embodiment, either or both the ring circuit lines (200,201) and the control line (202) of either or both circuits (A and B) can be omitted for particular applications or a single set of lines (200,201) and/or control line (202) common to both circuits (A and B) could be utilized. If both the ring circuit lines (200,201) and the control line (201) are omitted, the embodiment of the invention still provides two separate lighting circuits which can be used for different circumstances or uses as mentioned above.

The embodiment of FIGS. 8A-8I comprises a lighting system comprising a set of different length circuit boards each having four separate light circuits (A-D) provided thereon. Circuits (A,C and D) are similar "series-parallel" circuits but possibly running at different voltages with different types of illuminating devices of different rated voltages and located at different spacings, each circuit adapted for different operational purposes.

In circuit (A) of each circuit board a double switch (SW1) is provided in one voltage supply line (67) and the corresponding ring circuit voltage line (200) under the control of a specific signal transmitted along the control line (202). The switch (SW1) is normally closed but is opened when the specific control signal for that switch is received, to break both lines (200,202) at that point. When a series of circuit boards are connected together, the switch (SW1) of each such board can be separately addressed by a respective control signal transmitted along control line (202) to break the voltage supply at the position of the respective switch whereby no voltage is supplied to the illuminating devices (200) downstream of that point so that the light is terminated at that point or vice versa.

In circuit (C), a single switch (SW2) is provided in the series-parallel line (69) of each such circuit, under the control of a specific control signal transmitted along the control line (202). In such a circuit the illuminating devices of each circuit board can be switched off by transmitting the respective control signal for the switch (SW2) on that board along the control line (202). In this way, many specific effects can be achieved in practice, e.g. switching off specific sections of the elongate lighting, or flashing specific sections by switching such sections on and off sequentially, or producing a flashing sequence which flows along the length of the elongate lighting to indicate direction along the lighting system to a particular point which could for example be an emergency exit.

In circuit (D), the control line (202) is provided to control external ancillary equipment, e.g. spotlights, sirens, emergency warning signs, etc., provided at locations along the length of the lighting system. The control switches of such equipment are electrically connected to the control (202) to receive control signals transmitted therealong. At such locations the strip connector (206) include a flexible connector of the type shown in FIGS. 5A-5C, with a connector lead for the switch of the external equipment being spliced into the jumper wire for the control line (202) of circuit (D).

This lighting system includes a circuit (B) which provides a set of illuminating devices, lamps (60) and LEDs (60'), which can be connected individually in parallel across the voltage supply lines (67,68). A spur line (203) is provided on each board from one (67) of the voltage supply lines and pairs of corresponding connection points (207) on the spur line (203) and the second voltage supply line (68) are provided at spaced intervals along the lengths of the boards between which illuminating devices (60,60') can be selectively connected as required.

A diode (204) is inserted in the spur line (203) which transforms an AC supply across the voltage supply lines (67,68) into a DC supply for the LEDs (60'). The spur line (203) is controlled, downstream of diode (204) by a two-way switch (SW3) which is addressed by a respective specific control system transmitted along control line (202). The switch (SW3), in one position connects the spur line (203) to the voltage supply line (67) through the diode (204) and, in a second position, through a direct line (205).

This circuit (B) normally operates from an AC supply with the switch (SW3) addressed by a control signal to latch in its first position to connect with respect to the diode (204) which rectifies the AC supply to provide the necessary DC supply for the LEDs (60'). Failure of the AC supply could facilitate an automatic switch-over to an emergency battery supply. This requires removal of the original control signal along line (202) whereby switch (SW3) switches over to its second position so that the battery supply is then connected directly to the spur line (203) through line (205).

FIGS. 8A-8I also illustrate schematically the electrical circuits of resilient coupling elements (206) for connecting a selected series of the circuit boards in an end-to-end relationship. Each coupling element has a series of connections for each of the circuits (A-D). For circuits (A,C and D) there are electrical connections for each of the voltage supply lines (67,68), the series-parallel line (69), the ring circuit lines (200,201) and the control line (202). Normally the connection for series-parallel line (69) is only used, when severed portions of one particular circuit board is required for a particular installation. For circuit (B), there are electrical connections for each of the voltage supply lines (67,68), the ring circuit lines (200,201), the control line (202) and the voltage supply spur line (203). The electrical connection for the spur line (203) is again only used if an individual circuit board has to be cut during installation.

FIGS. 8A-8I further illustrate schematically a further circuit board (208) for location at a remote end of a series of circuit boards. The free end of the last circuit board of the series has a coupling element (206) attached thereto. The circuit board (208) is then connected to that circuit board by that coupling element. As illustrated in FIGS. 8A-8I, the circuit board (208) merely provides electric connections between the ring circuit lines (200,201) of each circuit (A-D) to its respective voltage supply line (67,68).

In some embodiments the wiring of each of the circuits (A-D) may be located side by side across each circuit board. However, where a narrow arrangement is desired, some of the electric lines may be provided on opposite sides of the circuit boards with the electrical connections, where necessary, being made through the circuit boards. Moreover, the lines may be provided in three or more planes with some of the lines being sandwiched between layers of the circuit board material.

Figure 9:
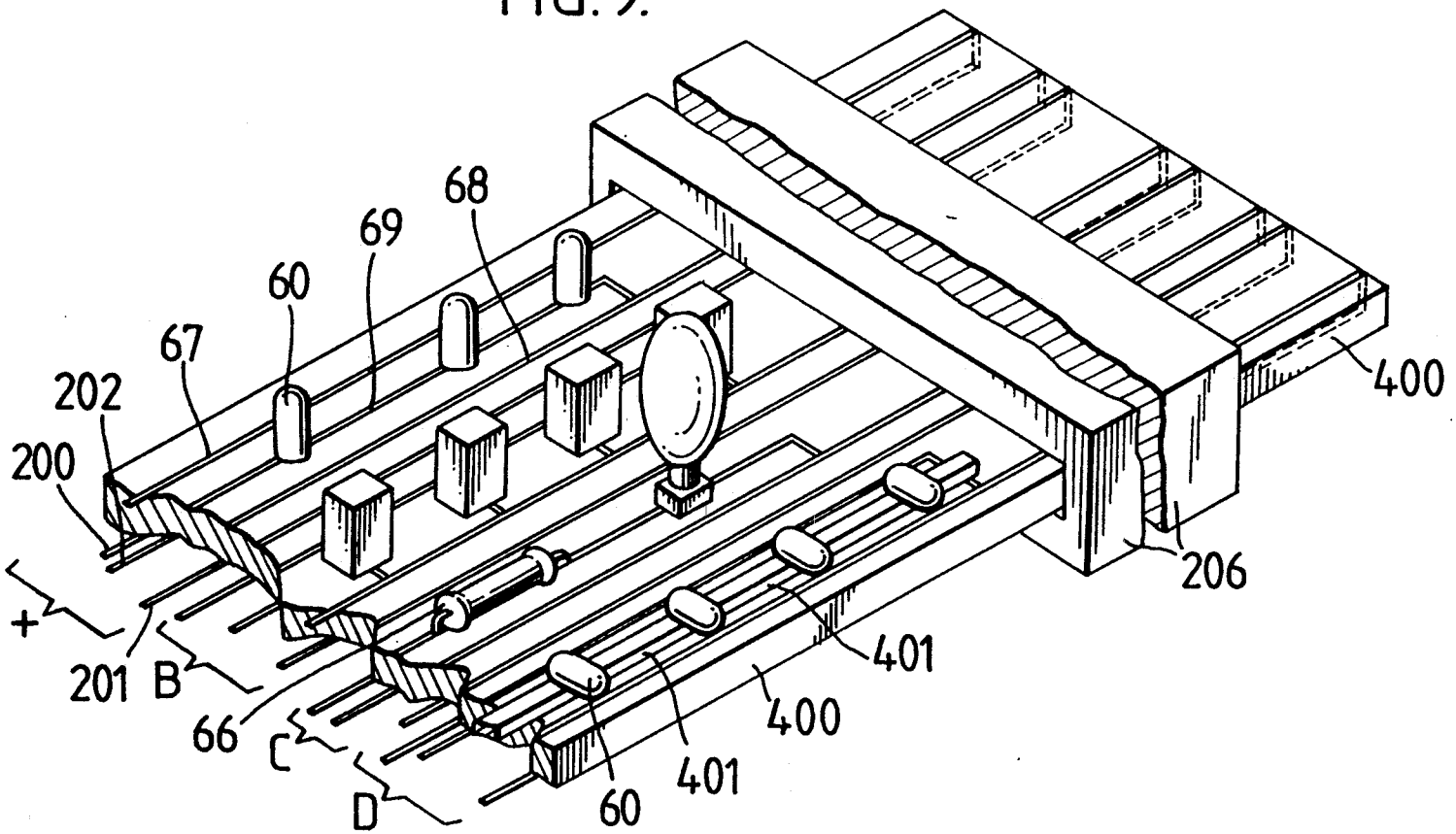
FIG. 9 is a diagrammatic perspective view of a circuit board of the embodiment of FIGS. 8A–8I.

FIG. 9 is a perspective illustration of a circuit board according to FIG. 8 wherein the ring circuit voltage supply lines (200,201) and the control signal line (202) are provided on the underside of the circuit boards (400). The light sources (60) of circuit (D) are laid flat on the circuit board (400) and a layer of resilient, heat resisting, cushioning material (401) is provided on the circuit board (400) beneath those light sources (60). This acts to prevent external vibrations from being transmitted through the housing via adjoining circuitry or components thereof and likewise being transmitted along the circuit board resulting in vibration damaging any filament or similar light emitting part of any given light source. End sections of a coupling device (206) is also illustrated.

FIGS. 10-15 illustrate diagrammatically components of another embodiment of the invention. A set of printed circuit boards (210), in accordance with FIG. or FIG. 6 or FIG. 7 or FIG. 8, are located in rectangular-section tubular, translucent housings (211), to provide a system which is water-sealed at least when the individual modular components are assembled to form an elongate lighting system.

A planar sealing element (212) is positioned on each end of the printed circuit board (211) with an electrical terminal portion thereof projecting through a slit in the seal (212). The outer periphery of the seal resiliently engages the inner periphery of the tubular housing (211) to support the circuit board (210) therein. Adjacent housings (211) are connected end-to-end by a coupling device (213) made of a resilient sealing material. The device (213) has a central outer peripheral flange (214) which fits and bridges between the end faces of the housings (211). The end sections of the device (213) fit within the end portions of the housings (211) and have outer peripheral ribs or 0-ring seals (215) which seal within the housings. The end faces of the device (213) have slits for receiving the projecting terminal portions (216) of the circuit boards (210). Embedded within the coupling device (213) are a plurality of metal connectors (217) for connecting electrically between corresponding terminals on the circuit boards within the adjacent housings (213). FIG. 14 illustrates an end plug (220) for providing a terminal fitting for a series of modules (211) connected end-to-end. The end plug (220) provides an end seal for the assembly, and may include circuitry for electrically connecting the remote ends of the voltage supply lines and ring circuit voltage supply lines provided on the circuit board (210) in the end housing (213) in which the plug is fitted. The plug includes a peripheral seal or O-ring (221) for sealing with the housing (211).

FIG. 15 illustrates one end of a flexible coupling device (222) comprising a pair of plug elements (223) connected by jumper leads (224). Each plug element (223) is also provided with a peripheral seal (224). Such a coupling device could have jumper leads of a considerable length, e.g. 10 meters, for applications where a series of spaced apart light strips are desired.

FIG. 16 illustrates a modified embodiment in which the circuit board (210) within tubular housing (211) has terminal connectors in the form of a bunch of wires projecting from the electric terminals at an end of the circuit board (210). The circuit board (210) is held by a connector (218) fitted within the housing (211) with a plug (212) being pushed into the connector (218) and supported on a support cup (213). An annular cushioning gasket (214) adjoins the support cup (213) and a cable grip (215) is provided to grip the terminal cables of the circuit board which extend through the central void (216) defined within the gasket (214). A tube bung (217) is located at the end of the housing (211) and has a serrated inner surface. An annular adapter (219) has one narrower end section (220) having an outer serrated section which locks within the bung (217) and a larger end section (221) projecting out of the housing and also having an outer serrated surface. The wire terminals extending through the adapter (219) are connected, e.g. by soldering, to those of an adjacent module and a fluid resistant sleeve encases the wires and is pushed onto the serrated outer surfaces of the projecting ends (221) of the adapters (219) of the two modules to provide a fluid resistant connection therebetween.

Figure 17:
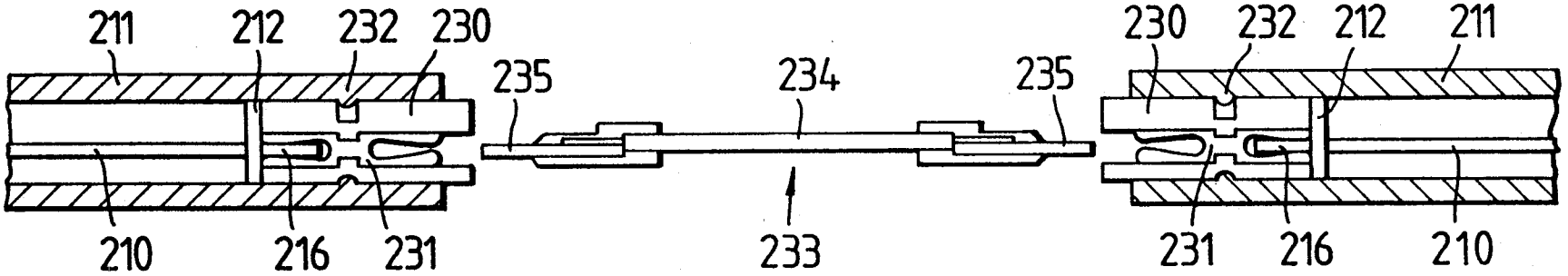
FIGS. 17 and 18 are, respectively, diagrammatic side and plan sectional views of connected portions of a pair of modules according to a yet further embodiment.
Figure 18:
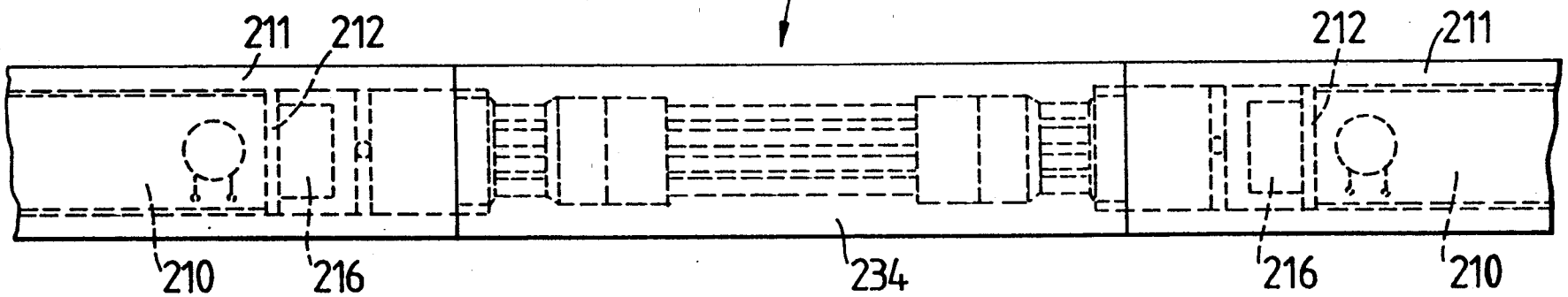

In the embodiment of FIGS. 17 and 18, coupling elements (230) having embedded therein electric connecting forks (231) are fixedly located in the housing ends by a fixing element (232), e.g. a screw, dowel or potting material, extending through a hole in the wall of the housing (211) to positively engage the coupling device (230).

The modules are connected by a rigid connector (233) comprising a printed circuit board (234) with end terminal portions (235) which are received in the exposed ends of the coupling elements (230).

Figure 19:
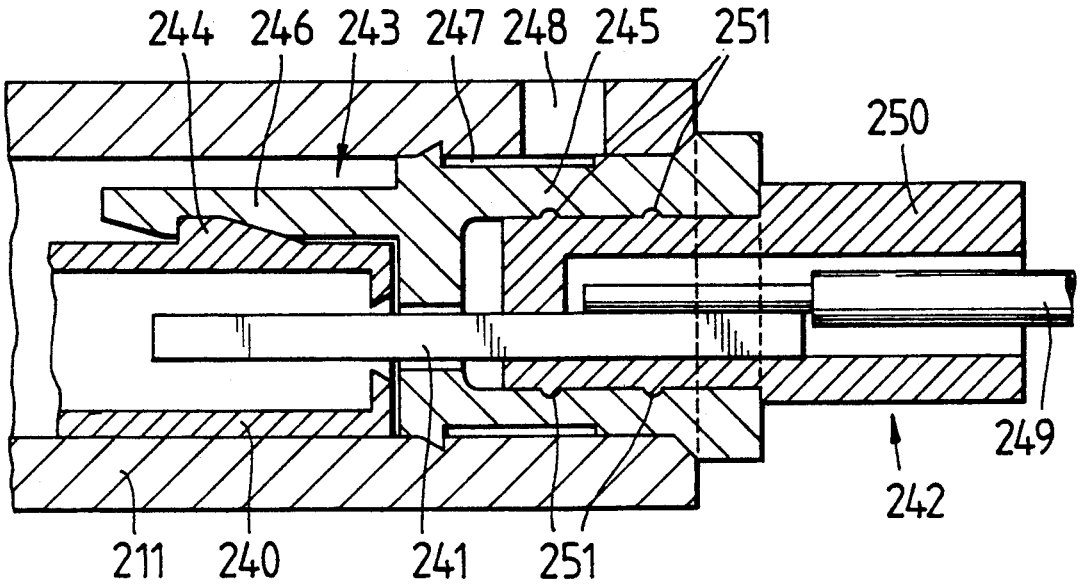
FIGS. 19 and 20 are, respectively, diagrammatic side and plan sectional views of an end portion and coupling device of another embodiment.
Figure 20:
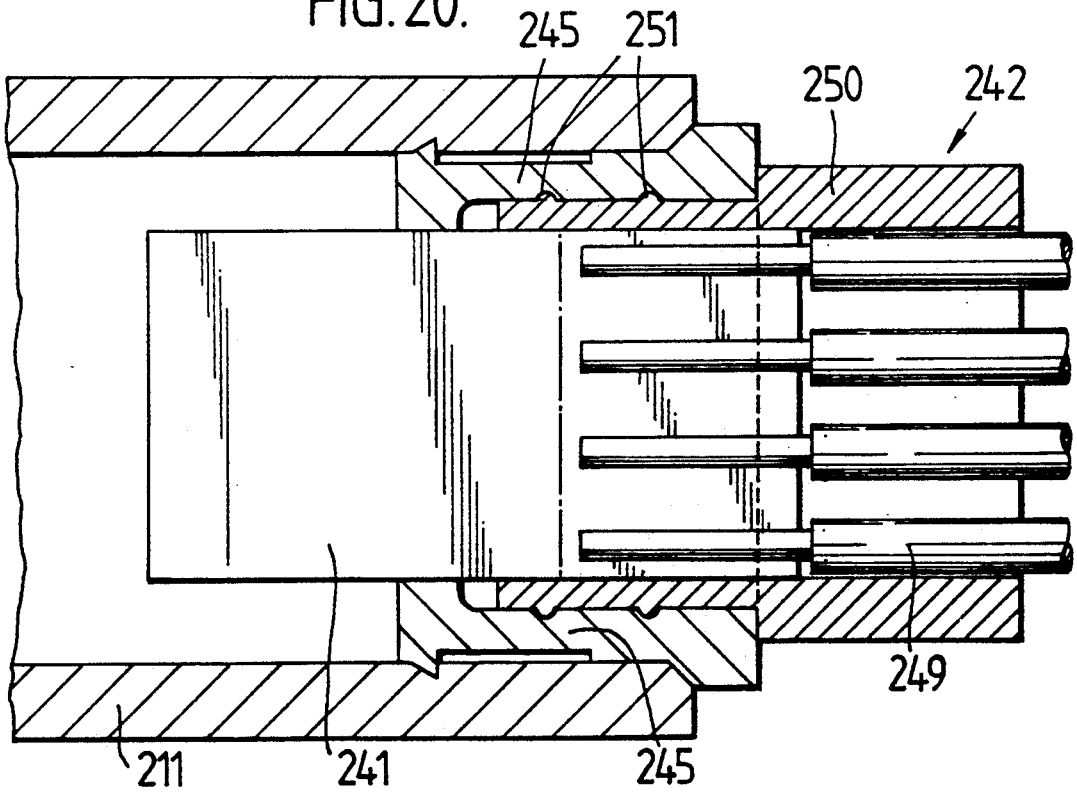

The embodiment of FIGS. 19 and 20 has a circuit board and seal not shown with a terminal portion of the board projecting from the board (not shown) similar to the parts (210,212,216) of the embodiment of FIGS. 17 and 18. An electrical coupling device (240) has slotted end sections to receive, at one end, the projecting terminal portion of the circuit board, and, at the other end, a terminal portion (241) of a flexible coupling device (242) to provide electrical connections between the respective electric terminal on the circuit board and on the terminal portion (241). The coupling device (240) has a recessed upper surface (243) with an upwardly extending latching projection (244) provided on the base wall of the recess (243). A cap (245) is located in the end of the housing (211) in abutment with the coupling device (240). The cap has an extension tab (246) which engages in the upper recessed portion (243) of the coupling device (240) to latch with the latching projection (244) therein. An annular recess (247) is defined in the outer periphery of the cap to receive glue or sealing material injected through an aperture (248) in the housing wall, which is subsequently filled.

The flexible coupling device (242) comprises a plurality of jumper leads (249) which are fixed at each end to a printed terminal board portion (241) with the connections therebetween being enclosed by a plug (250) having an end section which sealingly engages with the end cap (245) by means of sealing ribs (251) provided on the plug (250). A resilient gasket (252) is located between opposed abutment surfaces on the cap (245) and the plug (250) to resist the ingress of fluids into the housing (211).

Figure 21:
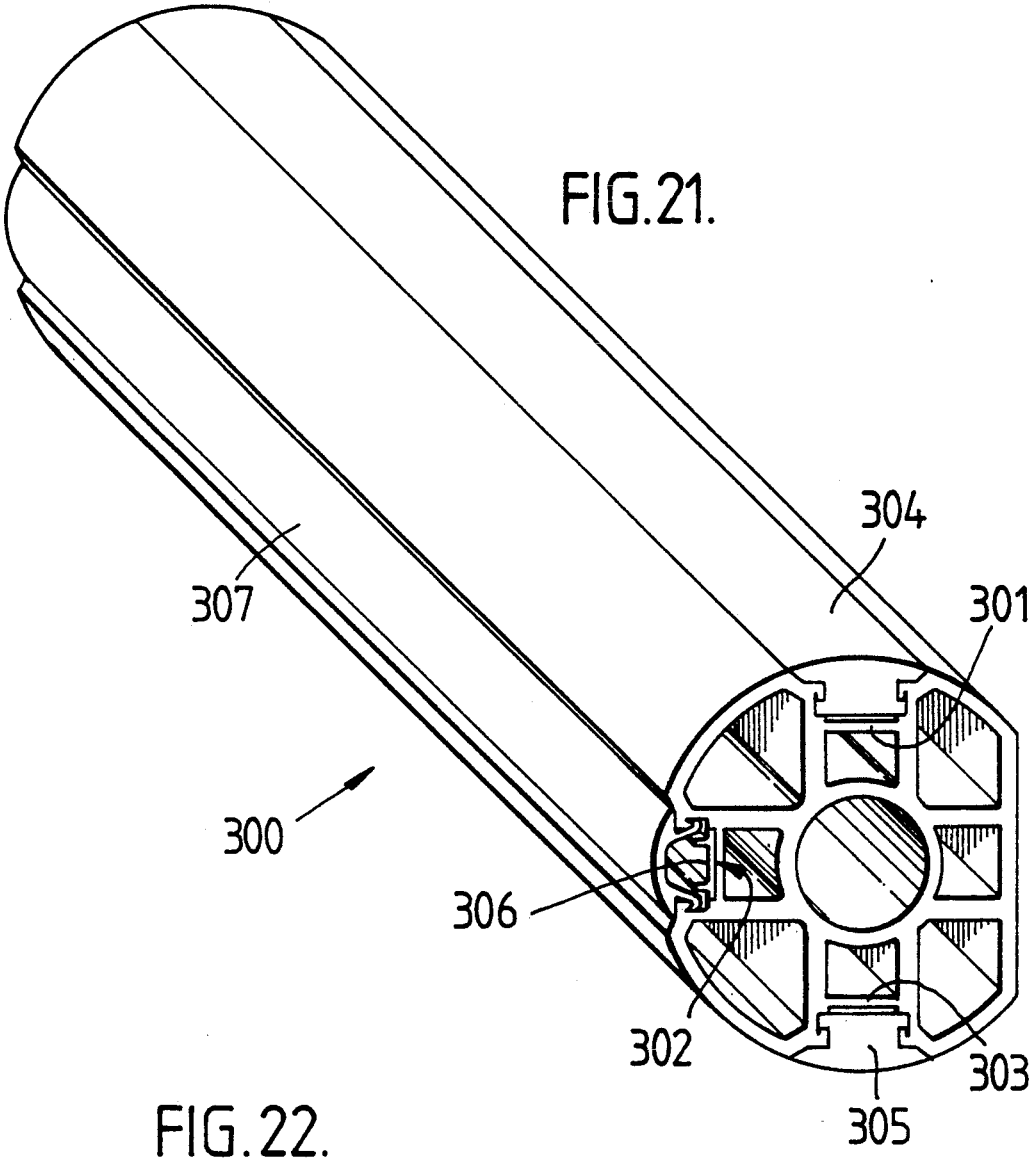
FIG. 21 is a diagrammatic perspective view of an extruded section for containing a lighting system according to the invention.

FIG. 21 illustrates an extruded aluminum handrail (300) formed with three lighting system receiving channels (301-303). The upper and lower channels (301,303) are, in the illustrated construction, not in use and are closed by elongate resilient gaskets (304,305) having a base formation which latches with overhanging side formations provided along the side walls of the channels.

The channel (302) is adapted to receive a lighting system according to the invention comprising a series of printed circuit boards connected end-to-end by intermediate coupling devices. An insulator base piece (306) is located in the base of the channel (302) and has a pair of spaced upstanding walls between which the printed circuit boards are disposed. The channel is closed by a snap-on top-section (307) made of a transparent, translucent or opalescent material, e.g. a plastics material such as a polycarbonate material. This construction, therefore, provides in use an elongate pencil-line of light extending along the top portion of the handrail.

Figure 22:
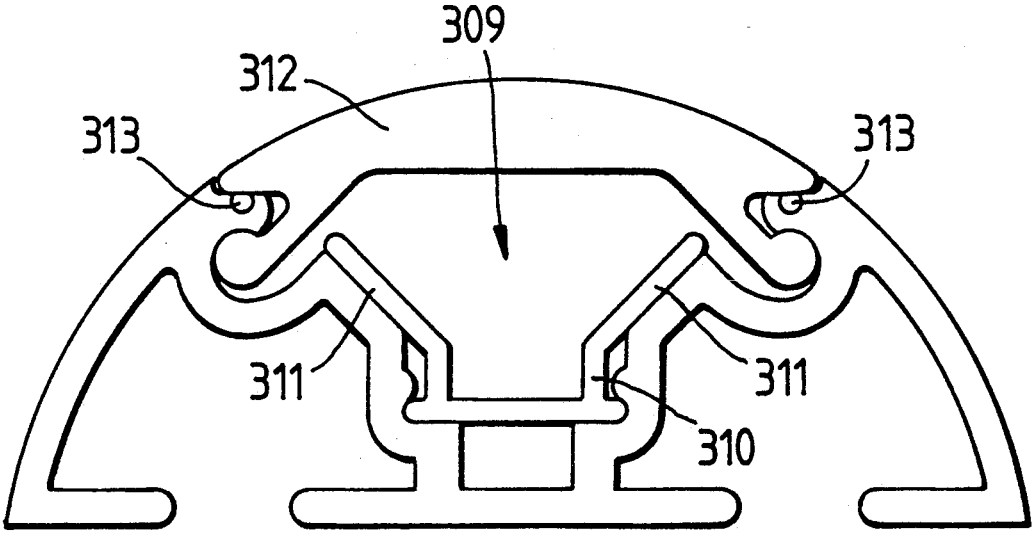
FIG. 22 is a cross-section through another extruded section for containing a lighting system according to the invention.

FIG. 22 illustrates another elongate housing extrusion (308) for receiving a lighting system according to the invention. The lighting system receiving channel (309) is provided with an insulator member (310) having upstanding walls formed with terminal sections (311) which diverge from one another. The member (310) is formed of a material which has light-reflective and also photo-luminescent properties so that it acts not only as a reflector in normal operation but also absorbs light energy to provide a glowing effect if there is a total black-out. The snap-on cover section (312) is provided with a pair of elongate resilient 0-section sealing members (313) to seal the channel (309) against the ingress of fluids.

Figure 24:
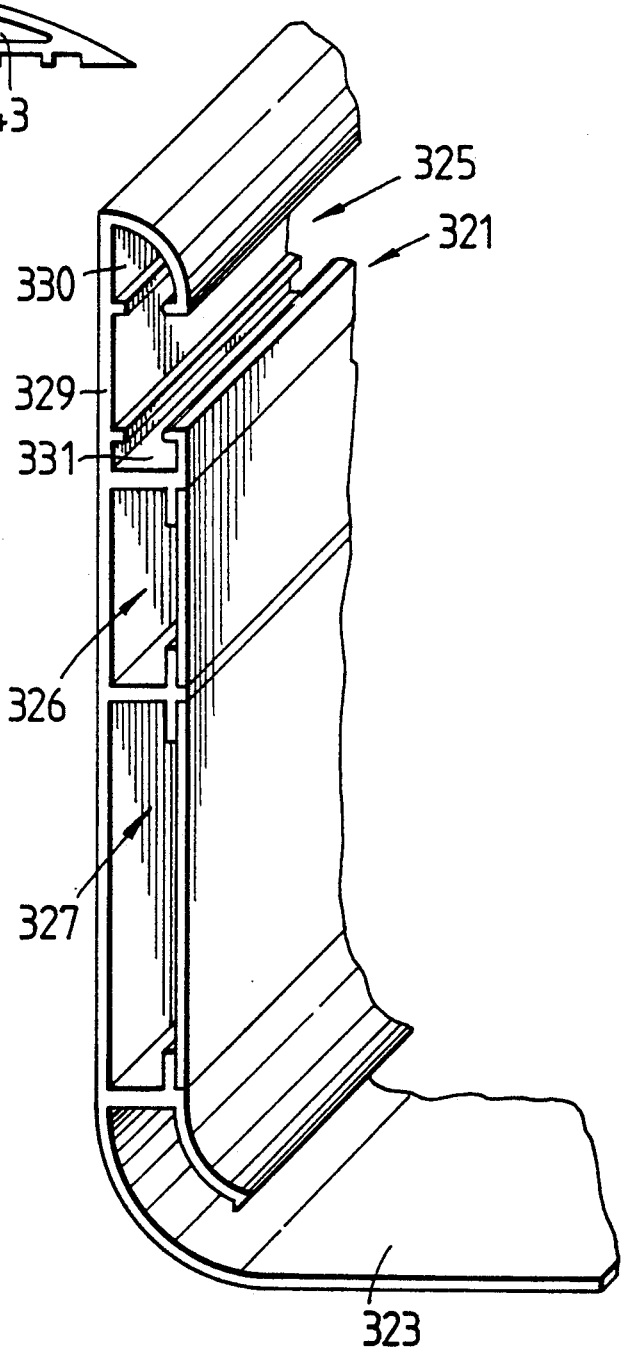
FIGS. 23 and 24 are, respectively, perspective details of two types of extruded skirting covings for housing a lighting system according to the invention.
Figure 23:
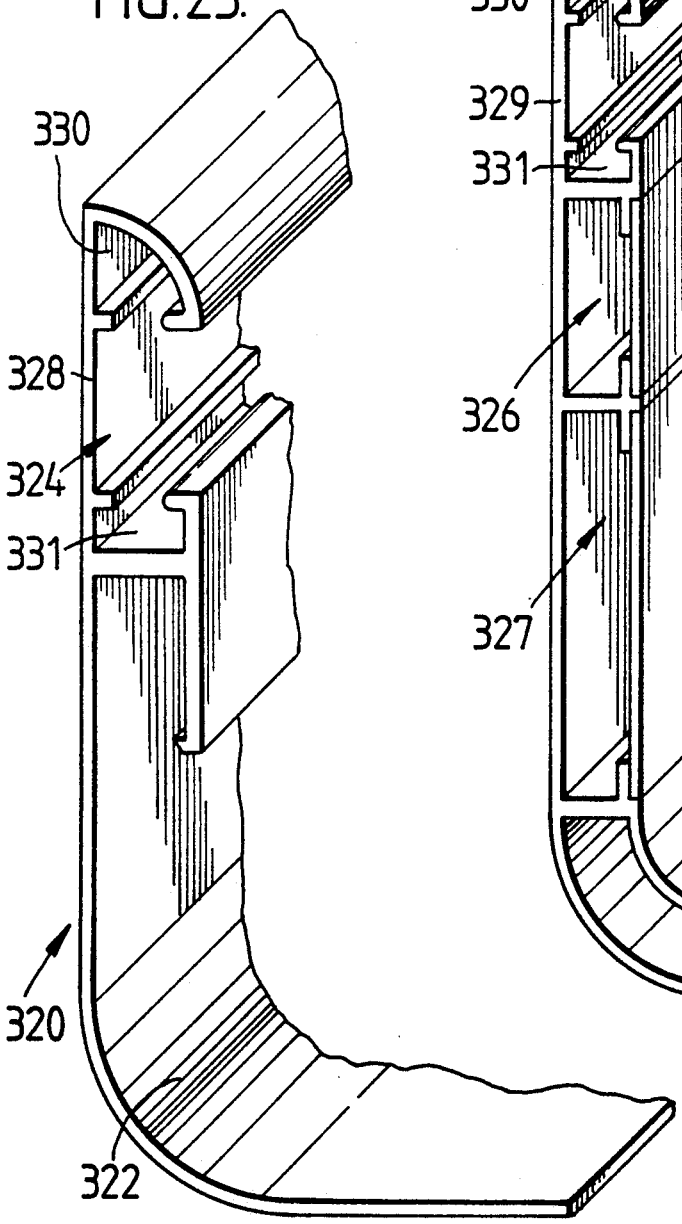

FIGS. 23 and 24 show similar extruded skirting covings (320,321) having curved base sections (322,323) to receive an edge portion of a floor covering and a lighting system receiving channel (324,325). Two further chambers (330,331) are formed, which communicate with the central sections (328,329) through slits in the side walls thereof. Instead of providing ring circuit supply lines (200,201) and signal control lines (202) directly on the circuit boards themselves, such lines can be provided by separate wires which are housed, respectively, in the chambers (330,331).

Figure 25:
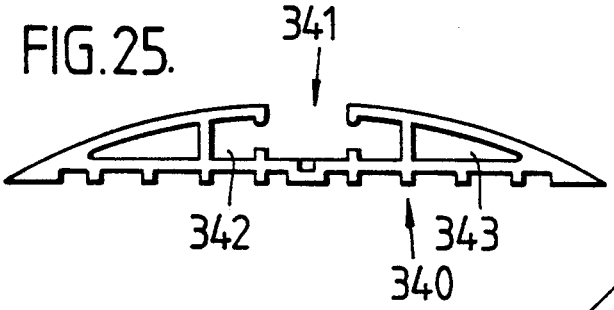
FIG. 25 is an end view of a ramp for receiving a lighting system embodying the invention.

FIG. 25 illustrates an extruded section (340) in the form of a ramp which can, for example, be mounted on a concrete floor to define a linear light therealong in a structure over which goods and vehicles can pass. The coving (321) of FIG. 24 is also formed with additional closed chambers (326,327) between the lighting system receiving channel (325) and a carpet trap (328), to receive, for example, mains supply cables and telephone cables, respectively. The channels (324,325) are adapted to receive a lighting system composed of modules of the type shown in FIGS. 12–20, in which the circuit boards are enclosed in generally rectangular-section housings (211). The modules are then housed in the central sections (328,329) of the channels (324,325). Along opposite sides of the central light module receiving sections (328,329) of the channels, ramp section (340) is also formed with a channel (341) having communicating side chambers (342,343) for receiving a lighting system similar to that which can be accommodated in the coverings (320,321) of FIGS. 23 and 24.

Figure 26:
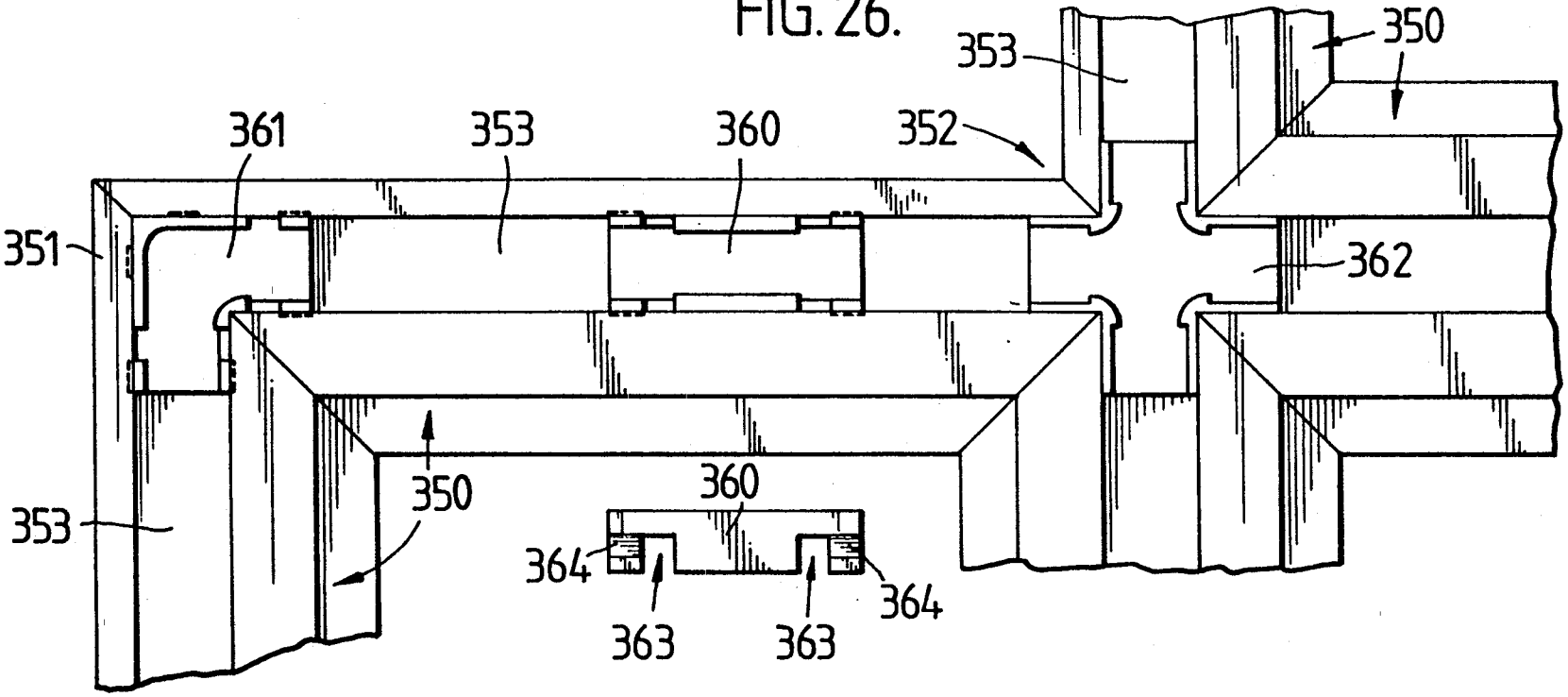
FIG. 26 is a plan view of a portion of a flooring housing system for receiving a lighting system according to the invention.
Figure 27:
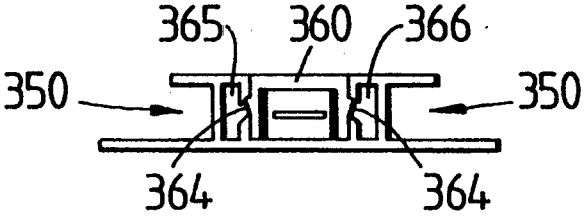
FIG. 27 is a cross-sectional view through a housing system similar to that of FIG. 26; and, FIG. 28 is an exploded perspective detail of a further embodiment.

FIGS. 26 and 27 illustrate a flooring system which can be provided with a lighting system similar to that which can be accommodated by the sections shown in FIGS. 23–25. The system of FIGS. 26 and 27 comprises linear extruded sections having upwardly open lighting system receiving channels, which can be laid on a floor with a carpet trap (350) on one side (FIG. 26) of the section or on both sides (FIG. 27) of the section.

In FIG. 26 the system includes right-angle corner joints (351) and cruciform joints (352) between straight sections of the lighting tracks. Similar curved joints or quadrant shaped joints can also be provided.

The lighting modules comprising outer rectangular housings (211) are received in the upwardly open channel (353) of the base sections. As described above in connection with FIGS. 19 and 20, the light modules are connected by flexible coupling devices (242) including a plurality of flexible jumper leads (249). These coupling devices between the modules are enclosed by spacer covers (360–362) which are, respectively, of straight, right-angle, curved, quadrant and cruciform shapes. Each cover is of a generally inverted channel shape section so as to be a push fit in the channel (353) of the base section. Each cover has side walls formed with apertures (363) therein and resilient latching projections (364) which provide a snap fit facility by resilient engagement in elongate slits formed along the side walls of the channel (353) in the base section.

The base section is also formed with a pair of further chambers (365,366) one along each side of the central channel (353) and communicating therewith through the slits in the side walls of the channels. As described above with reference to FIGS. 23 and 24, the side chambers (365,366) can contain external ring circuit supply lines (200,201) and signal control lines (202), respectively. The signal control lines (202) can be connected to switching means on the printed circuit boards of the series of lighting modules by spur lines which can pass through the apertures (363) in the side walls of the covers (360-362) to be spliced into one or more of the jumper leads (249) of the flexible coupling devices between the modules.

Mains and/or other power lines and/or control signal/data lines can be introduced into the lighting modules located in the channels (353) through sealed junction boxes provided in the flooring base sections in communication with the channels (353) formed in those base sections.

It will be appreciated that a lighting system comprising a set of circuit boards as illustrated in FIGS. 6–9 may be used other than in sealed tubular containers, e.g. as illustrated in FIGS. 21 and 22. For example such set of interconnected circuit boards may be merely laid in a trough provided as part of a structure. Moreover such a set could, for example, be laid beneath a glass covered structure such as a glass covered flooring.

Figure 28:
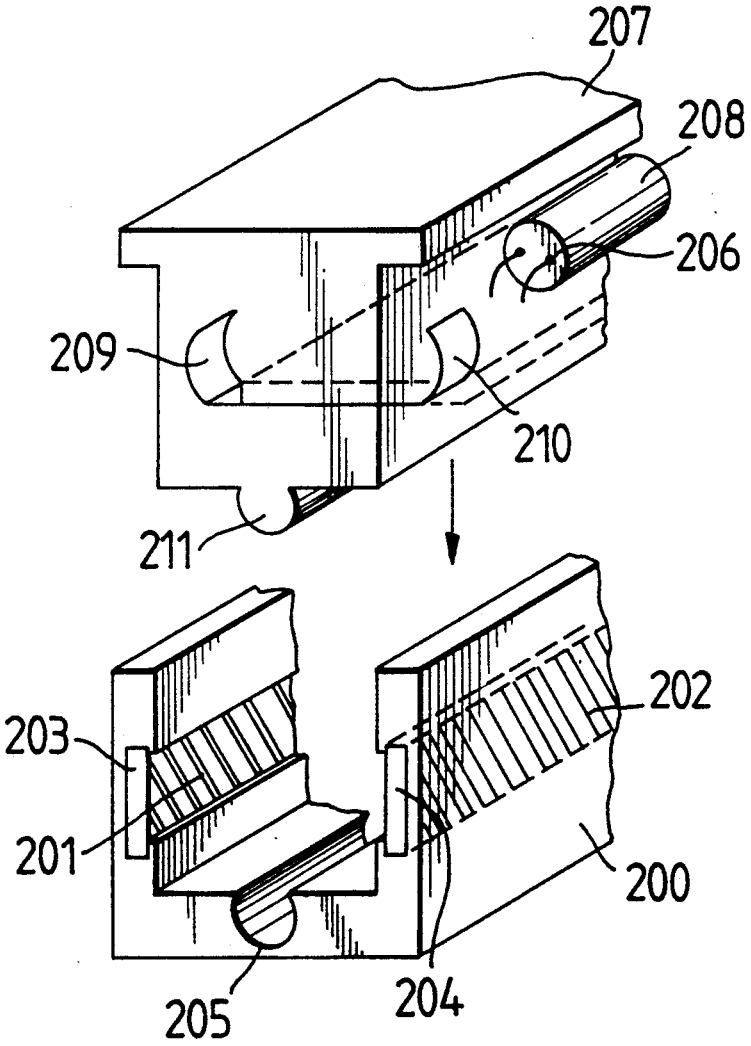

FIG. 28 illustrates another possible embodiment similar to that of FIG. 1 and comprising a channel-section, extruded base housing (200) having electric voltage supply tracks (201 and 202) located within corresponding rebates (203 and 204) formed in the opposite side walls of the housing (200). The base of the housing is formed with a part-circular recess (205) extending along its length. The base housing extrusion is cut to a length in accordance with the required application and secured to the support surface by screws or adhesive.

The modules described above are, in this embodiment, in the form of circuit boards (206) which is encapsulated in an elongate cast or moulded section (207). The lamps (208) and their associated electric circuitry are provided on the circuit board (206) before encapsulation. Resilient contact members (209,210) associated with the circuitry on the board (206) protrude outwardly of opposite sides of the module (207) to make contact with the voltage supply tracks (201,202), when the module is located in the housing (200), to apply a voltage across the lamps (208). A part-circular beading (211) is provided along the underside of each module (207) to plug into the recess (205) in the base of the housing (200). In this way, the required lighting system is built up from a selected group of modules (207), equivalent to the above described set of circuit boards of the previous embodiments, to provide lamps at the required spaced locations along the housing (200), after it has been cut to length and secured to the respective support surface. The modules are then plugged into the housing (200) with the required electrical connections being made automatically by engagement of the contact member (209,210) with the voltage supply tracks (201,202) in the housing. A voltage supply is then connected to the end of the housing (200) to apply the required running voltage of the system across the tracks (201,202).

I claim:

1. A lighting system including a plurality of modular components comprising a plurality of elongate strips of different finite lengths, each strip including having an elongate lighting circuit extending along the strip, which lighting circuit provides at least one pair of voltage supply lines extending along the length of the strip and a plurality of separate electrical connecting lines for connecting at least one illuminating device in parallel between said at least one pair of voltage supply lines, each of said connecting lines of at least one of said strips being adapted to connect at least one predetermined resistor in series with said at least one illuminating device thereof so that the total electrical resistance of said at least one illuminating device and said at least one resistor of the corresponding electrical connecting line associated with each of the strips is substantially the same to provide a set of corresponding voltage compatible electrical connecting lines provided on the plurality of elongate strips; connector means for engaging juxtaposed ends of said strips to connect the strips end to end, said connector means comprising at least one connector element for location between a pair of adjacent strips and having means for resiliently gripping each of said juxtaposed ends of the strips and means for making an electrical connection between adjacent ends of said respective electrical lighting circuits associated with the strips; and a voltage supply connector means for connecting to one end of one of said strips to provide an electrical connection between the voltage supply lines associated with that particular strip and at least one voltage supply.

2. A lighting system according to claim 11, wherein each strip is in the form of a printed circuit board.

3. A lighting system according to claim 2, wherein each printed circuit board is sealed within a respective outer tubular housing with electrical connecting terminals for said elongate lighting circuits being accessible at each end of said housing for engagement by said connector means and said voltage supply connector means.

4. A lighting system according to claim 1 including flexible connecting means for electrically connecting a pair of strips which can be set at different angular positions with respect to one another, said flexible connecting means comprising connector portions each adapted to be resiliently gripped by a respective one of a pair of said connector members which are to be resiliently engaged with adjacent ends of said pair of strips, respectively; flexible means connecting said connector portions; and electrical connecting means for making an electrical connection between the electrical connection means of said pair of connector members.

5. A lighting system according to claim further including a pair of ring circuit voltage supply lines for extending along the length of a set of said strips, when connected end to end, to connect ends of the respective voltage supply lines of said series of strips, remote from said voltage supply connector means, directly to said voltage supply.

6. A lighting system according to claim 5, wherein said ring circuit voltage supply lines are provided directly on each of said strips; said connector means being adapted to connect electrically the ring circuit voltage supply lines on said adjacent strips, and including a further connector element for location at said remote end of said series of strips and adapted to connect electrically the ring circuit voltage supply lines to the respective voltage supply lines at said remote end.

7. A lighting system according to claim 1 further including at least one control electric line for extending along the length of a set of said strips, when connected end to end, and switching means provided in said elongate lighting circuits associated with the strips or associated with ancillary equipment, said control line being capable of transmitting control signals to said switching means to control the operation thereof.

8. A lighting system as claimed in claim 7 wherein sections of said at least one control electric line are provided directly on each of said strips, and said connector means are adapted to connect electrically the control line sections on said adjacent strips.

9. A lighting system according to claim 1, further including an elongate tubular container having a translucent or transparent wall or wall portion, for receiving said plurality of elongate strips when connected by said connector means.

10. A lighting system according to claim 9 wherein said tubular container has a removably mounted wall section extending along its length.

11. A lighting system in including a plurality of modular components comprising a plurality of elongate strips of different finite lengths, each strip having an elongate lighting circuit extending along the strip, which lighting circuit provides at least one pair of voltage supply lines extending along the length of the strip and at least one electrical connecting line for connecting at least one illuminating device in parallel between said pair of voltage supply lines, said lighting circuit of at least one of said strips being adapted to connect at least one predetermined resistor in series with said at least one illuminating device thereof so that the total electrical resistance of said at least one illuminating device and said at least one resistor of each of the strips is substantially the same to provide a set of voltage compatible elongate strips; connector means for engaging juxtaposed ends of said strips to connect the strips end to end, said connector means comprising at least one connector element for location between a pair of adjacent strips and having means for resiliently gripping each of said juxtaposed ends of the strips and means for making an electrical connection between adjacent ends of said electrical lighting circuits associated with the strips; and a voltage supply connector means for connecting to one end of one of said strips to provide an electrical connection between the voltage supply lines associated with that particular strip and a voltage supply, wherein there is further provided a pair of ring circuit voltage supply lines for extending along the length of a set of said strips, when connected end to end, to connect ends of the respective voltage supply lines of said series of strips, remote from said voltage supply connector means, directly to said voltage supply.

12. A lighting system as claimed in claim 11 wherein said ring circuit voltage supply lines are provided directly on each of said strips; said connector means being adapted to connect electrically the ring circuit voltage supply lines on said adjacent strips; and including a further connector element for location at said remote end of said series of strips and adapted to connect electrically the ring circuit voltage supply lines to the respective voltage supply lines at said remote end.

13. A lighting system according to the claim 11, further including an elongate tubular container having a translucent or transparent wall or wall portion, for receiving said plurality of elongate strips when connected by said connector means.

14. A lighting system including a plurality of modular components comprising a plurality of elongate strips of different finite lengths, each strip having an elongate lighting circuit extending along the strip, which lighting circuit provides at least one pair of voltage supply lines extending along the length of the strip and at least one electrical connecting line for connecting at least one illuminating device in parallel between said pair of voltage supply lines, said lighting circuit of at least one of said strips being adapted to connect at least one predetermined resistor in series with said at least one illuminating device thereof so that the total electrical resistance of said at least one illuminating device and said at least one resistor of each of the strips is substantially the same to provide a set of voltage compatible elongate strips; connector means for engaging juxtaposed ends of said strips to connect the strips end to end, said connector means comprising at least one connector element for location between a pair of adjacent strips and having means for resiliently gripping each of said juxtaposed ends of the strips and means for making an electrical connection between adjacent ends of said electrical lighting circuits associated with the strips; and a voltage supply connector means for connecting to one end of one of said strips to provide an electrical connection between the voltage supply lines associated with that particular strip and a voltage supply, wherein there is further provided at least one control electric line for extending along the length of a set of said strips, when connected end to end, and switching means provided in said elongate lighting circuits associated with the stripsor associated with ancillary equipment, said control line being capable of transmitting control signals to said switching means to control the operation thereof.

15. A lighting system as claimed in claim 14, wherein sections of said at least one control electric line are provided directly on each of said strips; and said connector means are adapted to connect electrically the control electric line sections on said adjacent strips.

16. A lighting system according to the claim 14, further including an elongate tubular container having a translucent or transparent wall or wall portion, for receiving said plurality of elongate strips when connected by said connector means.

17. A lighting system including a plurality of modular components comprising a plurality of elongate strips of different finite lengths, each strip having an elongate lighting circuit extending along the strip, which lighting circuit provides at least one pair of voltage supply lines extending along the length of the strip and at least one illuminating device in parallel between said pair of voltage supply lines, and lighting circuit of at least one of said strips being adapted to connect at least one predetermined resistor in series with said at least one illuminating device thereof so that the total electrical resistance of said at least one illuminating device and said at least one resistor of each of the strips is substantially the same to provide a set of voltage compatible elongate strips; connector means for engaging juxtaposed ends of said strips to connect the strips end to end, said connector means comprising at least one connector element for location between a pair of adjacent strips and having means for resiliently gripping each of said juxtaposed ends of the strips and means for making an electrical connection between adjacent ends of said electrical lighting circuits associated with the strips; and a voltage supply connector means for connecting to one end of one of said strips to provide an electrical connection between the voltage supply lines associated with that particular strips and a voltage supply, wherein each strip is sealed within an outer tubular housing with electrical connecting terminals for said elongate lighting circuits being accessible at each end of said housing for engagement by said connector means and said voltage supply connector means.

18. A lighting system according to claim 17, further including an elongate tubular container having a translucent or transparent wall or wall portion, for receiving said plurality of elongate strips when connected by said connector means.

19. A lighting system including a plurality of modular components comprising a plurality of modules of different finite lengths, each module including at least one elongate lighting circuit extending along the module, which lighting circuit includes a series connected plurality of illuminating devices and resilient terminals for said circuit, protruding from the module and the lighting circuit of at least one of said strips being adapted to connect at least one predetermined resistor in series with said series connected plurality of illuminating devices thereof so that the total electrical resistance of said series connected plurality of illuminating device and at least one resistor of each of the modules is substantially the same to provide a set of voltage compatible elongate strips; an elongate base section provided with at least one pair of voltage supply lines running along its length and means for locating a selected series of modules on the base section in an end to end relationship with said terminals of each lighting circuit of each module making electrical contact with said voltage supply lines to apply a voltage across said series connected plurality of illuminating devices associated with the modules.

20. A lighting system according to claim 19, further including an elongate tubular container having a translucent or transparent wall or wall portion, for receiving said plurality of elongate strips when connected by said connector means.

* * * * *